US005547830A

United States Patent [19]

Asami

[11] Patent Number: 5,547,830

[45] **Date of Patent: * Aug. 20, 1996**

[54] SILVER HALIDE PHOTOGRAPHIC MATERIAL COMPRISING IRON CONTAINING SILVER HALIDE GRAINS AND METHOD FOR FORMING IMAGES USING THE SAME

[75] Inventor: Masahiro Asami, Kanagawa, Japan

[73] Assignee: Fuji Photo Film Co., Ltd., Kanagawa, Japan

[ * ] Notice: The portion of the term of this patent subsequent to Dec. 28, 2010, has been disclaimed.

[21] Appl. No.: 381,421

[22] Filed: Jan. 31, 1995

Related U.S. Application Data

[63] Continuation of Ser. No. 148,405, Nov. 8, 1993, abandoned, which is a continuation of Ser. No. 878,920, May 6, 1992, abandoned.

[30] Foreign Application Priority Data

May 10, 1991 [JP] Japan ..... 3-133267

[51] Int. Cl.[6] ..... G03C 1/09

[52] U.S. Cl. ..... 430/603; 430/567; 430/569; 430/604

[58] Field of Search ..... 430/567, 569, 430/603, 604

[56] References Cited

U.S. PATENT DOCUMENTS

| | | | |
|---|---|---|---|
| 3,772,031 | 11/1973 | Berry et al. | 430/603 |
| 5,057,402 | 10/1991 | Shiba et al. | 430/604 |
| 5,112,732 | 5/1992 | Hayashi et al. | 430/569 |
| 5,273,872 | 12/1993 | Asami | 430/567 |

FOREIGN PATENT DOCUMENTS

| | | | |
|---|---|---|---|
| 350046 | 1/1990 | European Pat. Off. | 430/614 |
| 423765 | 4/1991 | European Pat. Off. | 430/604 |

*Primary Examiner*—Janet C. Baxter

*Attorney, Agent, or Firm*—Sughrue, Mion, Zinn, Macpeak & Seas

[57] ABSTRACT

A silver halide photographic material comprising a support and at least one light-sensitive emulsion layer provided thereon, wherein the emulsion layer comprises a silver halide emulsion containing silver halide grains formed of silver chlorobromide, silver chloroiodide or silver chloroiodobromide each containing at least 90 mol % of silver chloride, or silver chloride, wherein $10^{-7}$ to $10^{-3}$ mol/mol of silver halide of an iron compound and $10^{-7}$ to $10^{-4}$ mol/mol of silver halide of a sulfur group compound are added to the silver halide grains until physical ripening of the grains is completed. The photographic material is particularly suitable in an image forming method involving exposing the photographic material to laser beams for a short period of time.

10 Claims, No Drawings

SILVER HALIDE PHOTOGRAPHIC MATERIAL COMPRISING IRON CONTAINING SILVER HALIDE GRAINS AND METHOD FOR FORMING IMAGES USING THE SAME

This is a continuation of application Ser. No. 08/148,405, filed Nov. 8, 1993, now abandoned, which is a continuation of application Ser. No. 07/878,920, filed May 6, 1992, now abandoned.

FIELD OF THE INVENTION

The present invention relates to a silver halide photographic material and a method for forming images using the same. The photographic material of the present invention is particularly suitable for an image forming method in which brief exposure is conducted by a laser.

BACKGROUND OF THE INVENTION

In recent years, the systems of recording images by use of silver halide grains as sensitive elements and reproducing the images by so-called development processing to store them have been remarkably developed, and have been applied to various fields. Indeed, the market of color photography, which many people utilize for recording and enjoyment, has been continuously enlarged year after year. In particular, for the production of color prints, a demand towards finishing in a short period of time has increased, and high efficiency and high productivity have been increasingly required.

A color print finishing stage comprises, as well-known, exposure of photographic materials for prints which is performed by recording images on negative films and color development processing of the exposed photographic materials. The use of highly sensitive photographic materials results in a reduction in exposure time. On the other hand, in order to shorten the time of color development, it is necessary to use photographic materials capable of speeding development.

As techniques for solving such problems, the methods of processing color photographic materials containing so-called high silver chloride emulsions increased in silver chloride content, instead of silver chlorobromide emulsions which are high in silver bromide content, which have been widely used for photographic materials for color prints (hereinafter referred to as color photographic paper) are known. For example, PCT International Publication No. WO87/04534 discloses the method of processing rapidly, color photographic paper comprising a high silver chloride emulsion with a color developing solution substantially free of sulfite ions and benzyl alcohol.

For the purpose of providing a system capable of processing color photographic paper rapidly, attempts to put silver halide emulsions high in silver chloride content to practical use have been intensively made. It is known that silver halide emulsions high in silver chloride content are liable to produce fog and high sensitivity is difficult to attain. It is also known that such silver halide emulsions are apt to cause so-called reciprocity law failure, in which the sensitivity and the gradation fluctuate with a change in exposure illuminance. Further, it is known that the sensitivity is liable to fluctuate with a change in temperature upon exposure. These disadvantages have seriously hindered the high silver chloride emulsions from being commonly used in photographic practice.

In order to solve the above-described disadvantages of the high silver chloride emulsions, many techniques have been reported.

For example, JP-A-58-95736 (the term "JP-A" as used herein means an "unexamined published Japanese patent application"), JP-A-58-108533, JP-A-60-22284 and JP-A-60-222845 disclose high content silver chloride emulsions having various grain structures containing layers high in silver bromide content in the silver halide grains to give high sensitivity, while repressing the fog of the high silver chloride emulsions. As a result of studies conducted by the present inventors, high sensitive emulsion materials could be obtained according to these techniques. However, it was discovered that desensitizing easily took place when pressure was applied to the emulsion grains, which resulted in a defect.

On the other hand, JP-A-51-139323, JP-A-59-171947 and British Patent 2,109,576A disclose that the addition of group VIII metal compounds results in high sensitivity and in an improvement in reciprocity law failure. Further, JP-B-49-33781 (the term "JP-B" as used herein means an "examined Japanese patent publication"), JP-A-50-23618, JP-A-52-18310, JP-A-58-15952, JP-A-59-214028, JP-A-61-67845, West German Patents 2,226,877 and 2,708,466, and U.S. Pat. No. 3,703,584 disclose the addition of rhodium compounds or iridium compounds to achieve a high contrast and an improvement in reciprocity law failure. When the rhodium compounds are used, however, although hard emulsions can be obtained, significant desensitizing takes place. This is practically unfavorable. When the iridium compounds are used, the so-called latent image sensitization, i.e., the increase in development density with an elapse of time from the exposure of the photographic materials to the processing, is often observed. This is also unfavorable.

Furthermore, U.S. Pat. No. 4,269,927 discloses that high sensitivity can be obtained by adding cadmium, lead, copper, zinc or a mixture thereof to the inside of surface latent image type high silver chloride emulsion grains. Although this method gives the effect of slightly increasing the sensitivity and improving the reciprocity law failure, a fluctuation in sensitivity with a change in temperature upon exposure is not a sufficient improvement.

In addition, JP-B-48-35373 discloses that hard black and white photographic paper can be obtained at low cost by adding water-soluble iron compounds to silver chloride emulsions obtained by normal precipitation methods. Although the sensitivity of the silver chloride emulsions at high illuminance is surely increased by this method, a fluctuation in sensitivity with a change in temperature, particularly the temperature dependency of the sensitivity at high exposure illuminance, is not a sufficient improvement.

Further, JP-A-l-183647 discloses forming silver bromide-localized layers in the inside or on the surface of high silver chloride emulsion grains containing iron ions, whereby high sensitivity is obtained and further the fluctuation in sensitivity with a change in temperature upon exposure can be reduced. However, according to this method, the temperature dependency of the sensitivity at high exposure illuminance, is not improved sufficiently.

SUMMARY OF THE INVENTION

As apparent from the above description, a primary object of the present invention is to provide a high sensitive, hard silver halide emulsion excellent in rapid processing properties and low in fog, and a silver halide photographic material using the same.

Another object of the present invention is to provide a silver halide emulsion decreased in fluctuation in sensitivity and gradation at the exposure illuminance, particularly decreased in fluctuation in sensitivity with a change in temperature at high intensity of illumination upon brief exposure, and a silver halide photographic material using the same.

Still another object of the present invention is to provide a method for forming images using the abovedescribed photographic material.

The above-described objects of the present invention are attained by the following photographic material and image forming method:

(1) A silver halide photographic material comprising a support and at least one light-sensitive emulsion layer provided thereon, wherein said emulsion layer comprises a silver halide emulsion containing silver halide grains formed of silver chlorobromide, silver chloroiodide or silver chloroiodobromide each containing at least 90 mol % of silver chloride, or silver chloride, wherein $10^{-7}$ to $10^{-3}$ mol/mol of silver halide of an iron compound and $10^{-7}$ to $10^{-4}$ mol/mol of silver halide of a compound of a sulfur family element (hereinafter referred to as a "sulfur group compound"), are added to said silver halide grains until physical ripening of said grains is completed.

(2) The silver halide photographic material described in the above item (1), in which said iron compound contained in the grains is a divalent or trivalent iron complex compound coordinated by 5 or 6 cyano ligands.

(3) The silver halide photographic material described in the above item (1), in which said sulfur group compound is a selenium compound.

(4) The silver halide photographic material described in the above item (1), in which said iron compound and sulfur group compound are localized in a surface layer, which contains up to 50% of the grain volume from the surface of the silver halide grain.

(5) A method for forming images, comprising image exposing the silver halide photographic material described in the above item (1) for the short time of $10^{-3}$ second or less, and then developing said exposed material.

DETAILED DESCRIPTION OF THE INVENTION

U.S. Pat. No. 3,772,031 discloses the technique of dispersing 2 to 10 ppm of sulfur group ions substantially homogeneously in grains of silver halide emulsions in the formation of the grains. It reports that high sensitivity can be obtained thereby, and the generation of fog can be reduced when photographic materials are stored at a high temperature in a dry state. However, the results of studies of the present inventors have revealed that various problems were encountered when the technique of adding the sulfur group ions to the grains was applied to high silver chloride emulsions. Namely, fog was markedly increased with an increase in silver chloride content in the grains. More specifically, when the sulfur group ions were allowed to exist in forming the grains of the emulsions, fog was generated before an increase in sensitivity appeared, which resulted in difficulty in preparing emulsions with practical characteristics.

Based on such situations, the present inventors continued to study intensively. As a result, the present inventors discovered that the above-described disadvantages could be significantly reduced by allowing an iron compound and a sulfur group compound to coexist in silver halide grains having a high silver chloride content until physical ripening of the grains was completed, thus completing the present invention.

It was also discovered that a fluctuation in sensitivity with a change in temperature upon exposure was more markedly improved with the silver halide photographic materials of the present invention.

The silver halide emulsions of the present invention contain silver halide grains formed of silver chlorobromide, silver chloroiodide or silver chloroiodobromide containing at least 90 mol % of silver chloride, or silver chloride. The silver chloride content is preferably 95 mol %, and more preferably 98 mol %. Further, emulsions containing grains consisting of pure silver chloride, in addition to the iron compound and the sulfur group compound, are preferably used.

When the silver halide emulsions of the present invention contain silver bromide, it is also preferred that silver bromide-localized phases containing less than 70 mol % of silver bromide are formed in the inside or on the surface of the grains. In this case, the silver bromide-localized phase may take the form of a core inside the grain, the layer form of a shell or the non-layer discrete form. For example, as to the latter form, the silver bromide-localized phase is epitaxially bonded to an edge or a corner of the surface of the grain.

When the silver halide emulsions of the present invention contain silver iodide, it is preferred that silver iodide is contained in an amount of not more than 2 mol % per mol of silver halide.

In order to add the iron compound to the inside of the grains in the present invention, it is preferred to allow a water-soluble iron compound to coexist in a grain forming stage. The iron compounds contain divalent or trivalent iron ions, and are preferably water soluble within the range of the content used in the present invention. Iron complex compounds easily incorporated into the silver halide grains are particularly preferred. Specific examples of these compounds include ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous nitrate, basic ferric acetate, ferric albuminate, ammonium ferric acetate, ferric bromide, ferric chloride, ferric chromate, ferric citrate, ferric fluoride, ferric formate, ferric glycerophosphate, ferric hydroxide, acidic ferric phosphate, ferric nitrate, ferric phosphate, ferric pyrophosphate, sodium ferric pyrophosphate, ferric thiocyanate, ferric sulfate, ammonium ferric sulfate, guanidinium ferric sulfate, ammonium ferric citrate, potassium hexacyanoferrate (II), potassium pentacyanoammineferrate (II), iron (III) sodium ethylenedinitrilotetraacetate, potassium hexacyanoferrate (III), tris(bipyridyl) iron (III) chloride and potassium pentacyanonitrosylferrate (III).

Of these iron compounds, divalent or trivalent iron complex compounds coordinated by 5 or 6 cyan ligands are particularly preferred.

In forming the silver halide grains, the iron compounds described above are allowed to exist in solutions of dispersing media (gelatin or protective colloidal polymers), aqueous solutions of silver halides, aqueous solutions of silver salts or other aqueous solutions, whereby the iron compounds can be incorporated into the grains.

In the present invention, the amount of these iron compounds added is within the range of $10^{-7}$ to $10^{-3}$ mol/mol of silver halide, and more preferably within the range of $10^{-6}$ to $5\times10^{-4}$ mol/mol of silver halide.

The iron compounds used in the present invention may be contained in the silver halide grains by any distribution. Namely, the iron compound may be supplied upon reaction of a silver salt with a silver halide so as to homogeneously disperse the iron compound in the inside of the grain, or the iron compound may be supplied locally at a specified position e.g., the inside or the surface, of the grain.

In a preferred embodiment of the present invention, 80% or more of the iron compound is localized in the surface layer of the grain wherein the thickness of the surface of the grain is defined in that 50% of the entire grain volume is contained in the surface layer of the silver halide grain. The volume of the surface layer is preferably 40% or less, and more preferably 20% or less. The smallest possible volume of the surface layer (the thinnest possible surface layer) is advantageous in repressing an increase in internal sensitivity and obtaining high sensitivity. Such localization of the iron compound in the surface layer of the silver halide grain is achieved by forming a silver halide grain core other than the surface layer, and then supplying the iron compound with the addition of a water-soluble silver salt solution and an aqueous solution of a halide for formation of the surface layer.

In the present invention, if the amount of the iron compounds added to the silver halide grains is less than the above-described range, it is difficult to obtain the effect of the present invention. Conversely, if the content is too much, the disadvantage exists that desensitizing is liable to be induced by pressure.

It is preferred that the silver halide grains of the present invention contain the sulfur group compound in combination with the iron compound. In order to add these compounds to the silver halide grains, it is easy to allow these compounds to coexist in forming the silver halide grains. Namely, in forming the silver halide grains, these compounds are allowed to exist in solutions of dispersing media (gelatin or protective colloidal polymers), aqueous solutions of silver halides, aqueous solutions of silver salts or other aqueous solutions, whereby these compounds can be incorporated into the grains.

The sulfur group compounds preferably used in the present invention are well-known in the photographic science and include unstable compounds, namely compounds each of which easily releases a sulfur atom, a selenium atom, a tellurium atom or an ion thereof, after they have been added to reaction systems of the silver halides and the silver salts. Such compounds which can be used are described in U.S. Pat. Nos. 1,574,944, 1,623,499, 2,399,083, 3,297,446, 3,297,447, 3,320,069, 3,408,196, 3,408,197, 3,442,653, 3,402,670 and 359,385, French Patents 2,093,038 and 2,093,209, JP-B-52-34491, JP-B-52-34492, JP-B-53-295, JP-B-57-22090, JP-A-59-180536, JP-A-59-185330, JP-A-59-181337, JP-A-59-187338, JP-A-59-192241, JP-A-60-150046, JP-A-60-151637, JP-A-61-246738, British Patents 255,846 and 861,984, and H. E. Spencer et al. *Journal of Photographic Science,* 31, 158–169 (1983).

In the present invention, these sulfur group compounds are allowed to exist in solutions of dispersing media (gelatin or protective colloidal polymers), aqueous solutions of silver halides, aqueous solutions of silver salts or other aqueous solutions, in forming the silver halide grains. Alternatively, the sulfur group compound may be introduced into the reaction systems as different solutions during grain formation. In this manner, whereby the compounds can be incorporated into the grains.

The amount of the sulfur group compounds used in the present invention is within the range of $10^{-7}$ to $10^{-4}$ mol/mol of silver halide, and preferably within the range of $5\times10^{-6}$ to $5\times10^{-5}$ mol/mol of silver halide. If the amount of the sulfur group compounds added to the silver halide grains is less than the above-described range, it is difficult to obtain the effect of the present invention. On the other hand, if the amount excess this range, inconvenience such as the generation of fog occurs.

The sulfur group compounds used in the present invention may be contained in the silver halide grains by any distribution. Namely, the sulfur group compound may be supplied by reaction of a silver salt with a silver halide so as to homogeneously disperse the sulfur group compound in the inside of the grain, or the sulfur group compound may be supplied locally at a specified position, e.g., the inside or the surface, of the grain.

In a preferred embodiment of the present invention, the sulfur group compound is preferably contained in the dispersion with the iron compound described above. Namely, 80% or more of the sulfur group compound is localized in the surface layer containing up to 50% of the grain volume from the surface of the silver halide grain. The volume of the surface layer is preferably 40% or less, and more preferably 20% or less. Such localization of the sulfur group compound in the. above-described desired position is preferably achieved by forming a silver halide grain core other than the surface layer, and then supplying the sulfur group compound with the addition of a water-soluble silver salt solution and an aqueous solution of a halide for formation of the surface layer.

In the present invention, when sulfur-containing compounds are particularly used as the sulfur group compounds, the compounds must be "unstable compounds" as defined above. The sulfur group compounds of the present invention therefore exclude compounds containing sulfur but that are used as solvents for silver halides such as thioethers and tetrasubstituted thiourea compounds, compounds used as color sensitizing dyes such as thiacyanines, and compounds used as antifogging agents such as heterocyclic mercapto compounds.

Examples of the sulfur-containing "unstable compounds" include sodium thiosulfate, sodium sulfide, trisubstituted thiourea compounds, thiocarbamides, allyl isocyanates and thioformamides.

Of the sulfur group compounds, examples of the tellurium-containing compounds include tellurocarbamides, allyl isotellurocyanates, potassium tellurocyanate and allyltellurourea compounds.

In the present invention, of the sulfur group compounds, the use of the selenium compounds are particularly preferred. The unstable type selenium compounds preferably used in the present invention are described, for example, in JP-B-44-15748, JP-B-43-4889, Japanese Patent Application Nos. 2-130976 and 2-229300.

Specific examples of the unstable type selenium compounds include isoselenocyanates (for example, aliphatic isoselenocyanates such as allyl isoselenocyanate), selenourea compounds, selenoketones, selenoamides selenocarboxylic acids (for example, 2-selenopropionic acid and 2-selenobutyric acid), selenoesters, diacyl selenides (for example, bis(3-chloro-2,6-dimethoxybenzoyl) selenide), selenophosphates, phosphine selenides and colloidal metal selenium.

The stable type selenium compounds used in the present invention include compounds described in JP-B-46-4553, JP-B-52-34491 and JP-B-52-34492. Specific examples thereof include selenious acid, potassium selenocyanate, selenazoles, quaternary salts of selenazoles, diaryl selenide, diaryl diselenide, dialkyl selenide, dialkyl diselenide, 2-selenazolidinedione, 2-selenoxazolidinethione and their derivatives.

Of these selenium compounds, compounds represented by the following general formulae (I) and (II) are preferred:

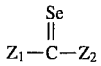

(I)

wherein $Z_1$ and $Z_2$, which may be the same or different, represent alkyl groups (for example, methyl, ethyl, t-butyl, adamantyl and t-octyl), alkenyl groups (for example, vinyl and propenyl), aralkyl groups (for example, benzyl and phenethyl), aryl groups (for example, phenyl, pentafluorophenyl, 4-chlorophenyl, 3-nitrophenyl, 4-octylsulfamoylphenyl and α-naphthyl), heterocyclic groups (for example, pyridyl, thienyl, furyl and imidazolyl), $—NR_1(R_2)$, $—OR_3$, or $—SR_4$.

$R_1$, $R_2$, $R_3$ and $R_4$, which may be the same or different, represent alkyl groups, aralkyl groups, aryl groups or heterocyclic groups. Examples of these groups include the same groups as listed for $Z_1$ with the proviso that $R_1$ and $R_2$ may be hydrogen atoms or acyl groups (for example, acetyl, propanoyl, benzoyl, heptafluorobutanoyl, difluoroacetyl, 4-nitrobenzoyl, α-naphthoyl and 4-trifluoromethylbenzoyl).

In general formula (I), $Z_1$ preferably represents an alkyl group, an aryl group or $—NR_1(R_2)$; and $Z_2$ preferably represents $—NR_5(R_6)$, wherein $R_1$, $R_2$, $R_5$ and $R_6$, which may be the same or different, represent hydrogen atoms, alkyl groups, aryl groups or acyl groups.

More preferably, general formula (I) represents an N,N-dialkylselenourea, an N,N,N'-trialkyl-N'-acylselenourea, a tetraalkylselenourea, an N,N-dialkyl-arylselenoamide or an N-alkyl-N-aryl-arylselenoamide.

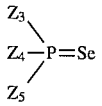

(II)

wherein $Z_3$, $Z_4$ and $Z_5$, which may be the same or different, represent aliphatic groups, aromatic groups, heterocyclic groups, $—OR_7$, $—NR_8(R_9)$, $—SR_{10}$, $—SeR_{11}$, —X or hydrogen atoms.

$R_7$, $R_{10}$ and $R_{11}$ represent aliphatic groups, aromatic groups, heterocyclic groups, hydrogen atoms or cations; $R_8$ and $R_9$ represent aliphatic groups, aromatic groups, heterocyclic groups or hydrogen atoms; and X represents a halogen atom.

In general formula (II), the aliphatic groups represented by $Z_3$, $Z_4$, $Z_5$, $R_7$, $R_8$, $R_9$, $R_{10}$ and $R_{11}$ are straight chain, branched chain or cyclic alkyl, alkenyl, alkynyl or aralkyl groups (for example, methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentynyl, benzyl and phenetyl).

In general formula (II), the aromatic groups represented by $Z_3$, $Z_4$, $Z_5$, $R_7$, $R_8$, $R_9$, $R_{10}$ and $R_{11}$ are monocyclic or condensed cyclic aryl groups (for example, phenyl, pentafluorophenyl, 4-chlorophenyl, 3-sulfophenyl, α-naphthyl and 4-methylphenyl).

In general formula (II), the heterocyclic groups represented by $Z_3$, $Z_4$, $Z_5$, $R_7$, $R_8$, $R_9$, $R_{10}$ and $R_{11}$ are 3- to 10-membered saturated or unsaturated heterocyclic groups each of which contain at least one of nitrogen, oxygen and sulfur atoms (for example, pyridyl, thienyl, furyl, thiazolyl, imidazolyl and benzimidazolyl).

In general formula (II), the cations represented by $R_7$, $R_{10}$ and $R_{11}$ are alkaline metal atoms or ammonium. In addition, the halogen atom represented by X is, for example, a fluorine atom, a chlorine atom, a bromine atom or an iodine atom.

In general formula (II), $Z_3$, $Z_4$ or $Z_5$ preferably represents an aliphatic group, an aromatic group or $—OR_7$, and $R_7$ represents an aliphatic group or an aromatic group.

More preferably, general formula (II) represents trialkylphosphine selenides, triarylphosphine selenides, trialkyl selenophosphates and triaryl selenophosphates.

Specific examples of the compounds represented by general formulae (I) and (II) are shown below, but the present invention is not limited thereto.

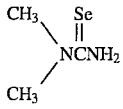

1.

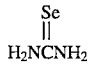

2.

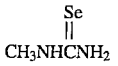

3.

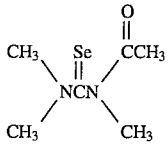

4.

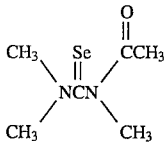

5.

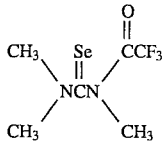

6.

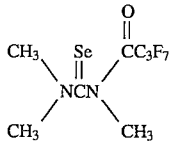

7.

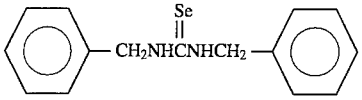

8.

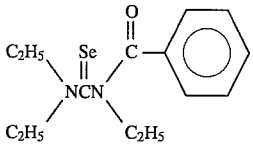

9.

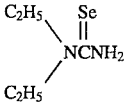

10.

-continued
11.
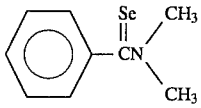
12.
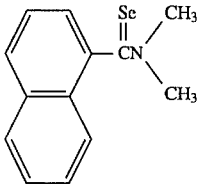
13.
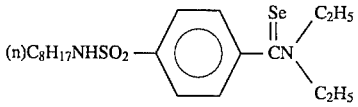
14.
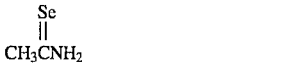
15.
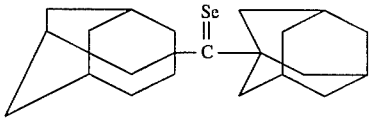
16.
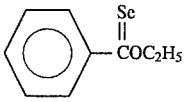
17.
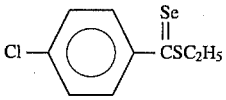
18.
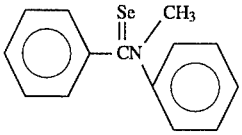
19.
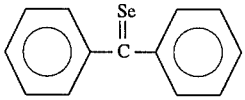
20.
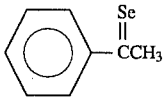
21.
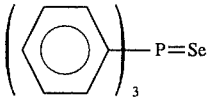
22.
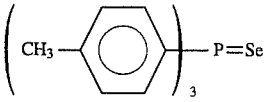
23.
$(nC_4H_9)_3P{=}Se$
24.
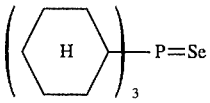
-continued
25.
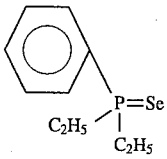
26.
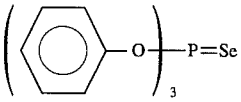
27.
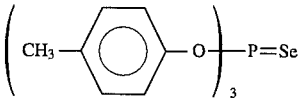
28.
$(nC_4H_9)_3P{=}Se$
29.
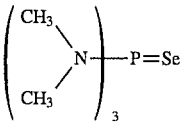
30.
$(C_2H_5O)_3P{=}Se$
31.
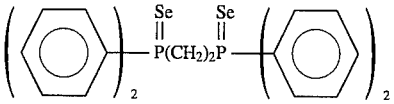
32.
$(nC_8H_{17})_3P{=}Se$
33.
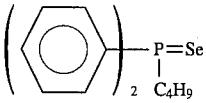
34.
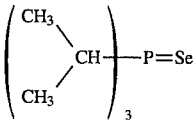
35.
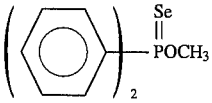
36.
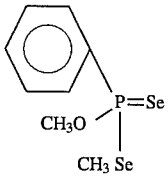
37.
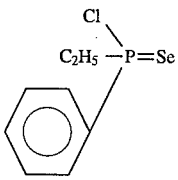
38.
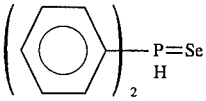

-continued

39. 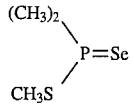

In the present invention, the silver halide photographic emulsions containing the silver halide grains with a mean grain size of 0.1 to 2.0 μm are preferably used. The mean grain size is a mean value of grain sizes represented by the diameters of circles equivalent to the projected areas of the grains.

Further, it is preferred that these emulsions are so-called monodisperse emulsions, i.e., having a narrow grain size distribution. Specifically, the emulsions have a coefficient of variation (the standard deviation of the grain size distribution divided by the mean grain size) of not more than 20%, desirably not more than 15%. At this time, for the purpose of obtaining a wide latitude, it is preferred that the above-described monodisperse emulsions can be blended in the same layer, or can be coated in the form of multiple layers.

The silver halide grains contained in the silver halide photographic emulsions of the present invention preferably have a regular crystal form such as a cubic, an octahedral or a tetradecahedral form. However, the grains having an irregular crystal form such as a spherical form or a plate (tabular) form may be mixed therewith. In the present invention, it is desirable that the emulsions contain at least 50%, preferably at least 70% and more preferably at least 90%, of the above-described grains having a regular crystal form.

Other than these, an emulsion can also be used in which more than 50% of all grains as a projected area are composed of plate-form grains having a mean aspect ratio (a ratio of diameter calculated as circle/thickness) of at least 5 and preferably at least 8.

The silver halide photographic emulsions of the present invention can be prepared according to the methods described in P. Glafkides, *Chimie et Phisique Photographique* (Paul Montel, 1967); G. F. Duffin, *Photographic Emulsion Chemistry* (Focal Press, 1966); and V. L. Zelikman et al., *Making and Coating Photographic Emulsion* (Focal Press, 1964). Namely, an acid process, a neutral process or an ammonium process may be used. A soluble silver salt and a soluble halide may be reacted with each other by using a single jet process, a double jet process or a combination thereof. The process of forming grains in the presence of excess silver ions, i.e., the reverse mixing process, can also be used. As a type of double jet process, a controlled double jet process can be used. In this process, the silver ion concentration (pAg) is maintained constant in the reaction liquid phase, thereby forming a silver halide. Using this process, a silver halide emulsion having a regular crystal form and a monodisperse grain size can be obtained.

In the course of formation of grain emulsions or physical ripening, various multivalent metal ion impurities, other than iron and selenium compounds, can be introduced into the silver halide photographic emulsions of the present invention. Examples of the compounds which can be used include salts of cadmium, zinc, lead, copper and thallium; salts or complex salts of the Group VII elements of the Periodic Table, such as rhenium; and salts or complex salts of the Group VIII elements of the Periodic Table, such as ruthenium, rhodium, palladium, osmium, iridium and platinum. In particular, the salts or the complex salts of the Group VIII elements of the Periodic Table can be preferably used in combination. Although the amount of these compounds added varies over a wide range depending on the desired result, it is preferred that the compounds are added in an amount of $10^{-9}$ to $10^{-2}$ mol/mol of silver halide.

The silver halide emulsions of the present invention are generally subjected to chemical and spectral sensitization.

With respect to chemical sensitization, sulfur sensitization represented by addition of the unstable sulfur compounds described above, selenium sensitization, tellurium sensitization, noble metal sensitization represented by gold sensitization, and reduction sensitization can be used alone or in combination. In addition to the unstable sulfur group compounds already described, the compounds described on page 18, lower right column to page 22, upper right column of JP-A-62-215272 are preferably used for chemical sensitization.

Spectral sensitization is carried out for the purpose of spectrally sensitizing, within a desired light wavelength range, the silver halide photographic emulsion of the present invention. In the present invention, it is preferred that spectral sensitization is carried out by adding a dye capable of absorbing light within a wavelength range corresponding to a desired spectral sensitivity, namely a spectrally sensitizing dye. The spectrally sensitizing dyes used in this case include, for example, dyes described, in F. M. Harmer, *Heterocyclic Compounds-Cyanine Dyes and Related Compounds* (John Wiley & Sons, New York and London, 1964). Specific examples of the compounds; and spectrally sensitizing methods which are preferably used are described on page 22, upper right column to page 38 of JP-A-62-215272.

In order to prevent fog during manufacturing, storage or photographic processing of the photographic materials, or to stabilize photographic properties thereof, various compounds or their precursors may be added to the silver halide photographic emulsions of the present invention. Specific examples of these compounds preferably used are described on pages 39 to 72 of JP-A-62-215272 described above.

The silver halide photographic emulsions of the present invention are preferably used as surface latent image type emulsions, in which latent images are formed mainly on the surface of the grains.

The silver halides which can be used in the present invention include silver chloride, silver bromide, silver (iodo)chlorobromide and silver iodobromide. For rapid processing, it is particularly preferred to use silver chlorobromide or silver chloride which is substantially free from silver iodide and contains at least 90 mol %, preferably at least 95 mol %, and more preferably at least 98 mol % of silver chloride.

In order to improve the sharpness of images, the photographic materials of the present invention preferably contain dyes decolorizable by treatment (particularly oxonol dyes) described on pages 27 to 76 of European Patent EP0,337,490A2 in their hydrophilic colloidal layers, so as to give an optical reflection density of 0.70 or more at 680 nm or preferably contain at least 12% by weight (more preferably, at least 14% by weight) of a titanium oxide surface treated with divalent to tetravalent alcohols (for example, trimethylolethane) in the water-resistant resin layers of their supports.

As high boiling solvents for photographic additives such as cyan, magenta and yellow couplers, any solvents may be used as long as they are water-immiscible compounds having a melting point of not more than 100° C. and a boiling point of at least 140° C., and are good coupler solvents. The melting point of the high boiling solvents is preferably at least 160° C. and more preferably at least 170° C.

Details of these high boiling solvents are described on page 137, lower right column to page 144, upper right column of JP-A-62-215272.

Cyan, magenta or yellow couplers can be impregnated with loadable latex polymers (for details, see U.S. Pat. No. 4,203,716) in the presence or in the absence of the above-described high boiling organic solvents, or the couplers can also be dissolved in water-insoluble, organic solvent-soluble polymers. Then, they can be emulsified in aqueous solutions of hydrophilic colloids.

The homopolymers or copolymers described in columns 7 to 15 of U.S. Pat. No. 4,857,449 and on pages 12 to 30 of PCT International Publication No. WO088/00723, are preferably used. More preferably, the use of methacrylate or acrylamide polymers, particularly the use of the acrylamide polymers, is preferable in respect to image stabilization.

In the photographic materials of the present invention, compounds for improving and protecting the quality of color images described in European Patent EP0,277,589A2, are preferably used in combination with the couplers disclosed above. In particular, they are preferably used in combination with pyrazoloazole couplers.

In order to prevent the production of stains when forming a dye via reaction with a color developing agent, which remains in the film, or an oxide thereof, with a coupler during storage after processing, and other side effects, it is preferred to use a compound (F) described in EP 0,277,589A2. Compound (F) is chemically bonded to an aromatic amine developing agent, which remains after color development to form a chemically inactive, substantially colorless compound. A compound (G) described in the above European patent which is chemically bonded to an oxide of the aromatic amine color developing agent which remains after color development to form a chemically inactive, substantially colorless compound can also be used alone or in combination with compound (F).

Further, it is preferred that antifungal agents, as described in JP-A-63-271247, are added to the photographic materials of the present invention to prevent various molds and bacteria from breeding in the hydrophilic colloidal layers which cause the images to deteriorate.

A white polyester support, or a support with a white pigment-containing layer provided on the side of the support coated with silver halide emulsion layers, may be used as a support for display of the photographic material of the present invention. Furthermore, in order to improve the sharpness, an antihalation layer is preferably formed on the side of the support coated with a silver halide emulsion layers or on the back surface of the support. In particular, it is preferred that the transmission density is established within the range of 0.35 to 0.8 so that the display can be enhanced with both reflected light and transmitted light.

The photographic materials of the present invention may be exposed to visible light or infrared light. Exposing methods may be either low or high illumination exposure for a short time. In particular, in the present invention, an exposing method in which the exposure time per picture element is shorter than $10^{-3}$ second is preferred. A laser scanning exposing method in which the exposing time is shorter than $10^{-4}$ second is more preferred.

In exposing, the band stop filter described in U.S. Pat. No. 4,880,726 is preferably used. By use of this filter, optical color mixing is eliminated and color reproducibility is markedly improved.

The exposed photographic materials can be subjected to conventional black and white or color development. In the case of color photographic materials, it is preferred that bleach-fixing is conducted after color development for rapid processing. In particular, when the above-described high silver chloride emulsion is used, the pH of a bleach-fixing solution is preferably about 6.5 or less, and more preferably about 6 or less, for the purpose of enhancing desilverization.

Silver halide emulsions, other materials (such as additives) and photographic constituent layers (such as layer arrangement) applied to the photographic materials of the present invention, and processing methods and additives for processing applied to treat the photographic materials, which are preferably used, are described in the following patents shown in Table 1, particularly in European Patent EP0,355,660A2 (JP-A-2-139544).

TABLE 1

| Photographic Constituents, etc. | JP-A-62-215272 | JP-A-2-33144 | EP0,355,660A2 |
|---|---|---|---|
| Silver Halide Emulsions | Page 10, upper right column, line 6 to page 12, lower column, line 5; page 12, lower right column, line 4 from the bottom to page 13, upper left column, line 17 | Page 28, upper right column, line 16 to page 29, lower right column, line 11; page 30, line 2 to line 5 | Page 45, line 53 to page 47, line 3; page 47, line 20 to line 22 |
| Solvents for Silver Halides | Page 12, lower left column, line 6 to line 14; page 13, upper left column, line 3 from the bottom to page 18, lower left column, the last line | — | — |
| Chemical Sensitizers | Page 12, lower left column, line 3 from the bottom to lower right column, line 5 from the bottom; page 18, lower right column, line 1, to page 22, upper right column, line 9 from the bottom | Page 29, lower right column, line 12 to the last line | Page 47, line 4 to line 9 |
| Spectral Sensitizers (Spectrally Sensitizing Methods) | Page 22, upper right column, line 8 from the bottom to page 38, the last line | Page 30, upper left column, line 1 to line 13 | Page 47, line 10 to line 15 |
| Emulsion Stabilizers | Page 39, upper left column, line 1 to page 72, upper right column, the last line | Page 30, upper left column, line 14 to upper right column, line 1 | Page 47, line 16 to line 19 |
| Development Accelerators | Page 72, lower left column, line 1 to page 91, upper right column, line 3 | — | — |
| Color Couplers (Cyan, Magenta, Yellow Couplers) | Page 91, upper right column, line 4 to page 121, upper left column, line 6 | Page 3, upper right column, line 14 to page 18, upper left column, the last line; page 30, upper right column, line 6 to page 35, lower right column, line 11 | Page 4, line 15 to line 27; page 5, line 30 to page 28, the last line; page 45, line 29 to line 31; page 47, line 23 to page 63, line 50 |
| Color | Page 121, upper | — | — |

TABLE 1-continued

| Photographic Constituents, etc. | JP-A-62-215272 | JP-A-2-33144 | EP0,355,660A2 |
|---|---|---|---|
| Development Increasing Agents | left column, line 7 to page 125, upper right column, line 1 | | |
| Ultraviolet Absorbers | Page 125, upper right column, line 2 to page 127, lower left column, the last line | Page 37, lower right column, line 14 to page 38, upper left column, line 11 | Page 65, line 22 to line 31 |
| Antifading Agents (Image Stabilizers) | Page 127, lower right column, line 1 to page 137, lower left column, line 8 line 19 line 33 to line 40; page 65, line 2 to line 21 | Page 36, upper right column, line 12 to page 37, upper left column, line 19 | Page 4, line 30 to page 5, line 23; page 29, line 1 to page 45, line 25; page 45, line 33 to line 40; page 64, line 1 to line 51 |
| High Boiling and/or Low Boiling Organic Solvents | Page 137, lower left column, line 9 to page 144, upper right column, the last line | Page 35, lower right column, line 14 to page 36, upper left column, line 4 from the bottom | Page 64, line 1 to line 51 |
| Dispersing Methods of Photographic Additives | Page 144, lower left column, line 1 to page 146, upper right column, line 7 | Page 27, lower right column, line 10 to page 28, upper left column, the last line; page 35, lower right column, line 12 to page 36, upper right column, line 7 | Page 63, line 51 to page 64, line 56 |
| Hardener | Page 146, upper right column, line 8 to page 155, lower left column, line 4 | — | — |
| Developing Agent Precursors | Page 155, lower left column, line 5 to lower right column, line 2 | — | — |
| Development Restrainer-Releasing Compounds | Page 155, lower right column, line 3 to line 9 | — | — |
| Supports | Page 155, lower right column, line 19 to page 156, upper left column, line 14 line 3 | Page 38, upper right column, line 18 to page 39, upper left column, line 3 | Page 66, line 29 to page 67, line 13 |
| Photographic Material Layer Constitution | Page 156, upper left column, line 15 to page 156, lower right column, line 14 | Page 28, upper right column, line 1 to line 15 | Page 45, line 41 to line 52 |
| Dyes | Page 156, lower right column, line 15 to page 184, lower right column, the last line | Page 38, upper left column, line 12 to upper right column, line 7 | Page 66, line 18 to line 22 |
| Color Mixing Inhibitors | Page 185, upper left column, line 1 to page 188, lower right column, line 3 | Page 36, upper right column, line 8 to line 11 | Page 64, line 57 to page 65, line 1 |
| Gradation Modifiers | Page 188, lower right column, line 4 to line 8 | — | — |
| Stain Inhibitors | Page 188, lower right column, line 9 to page 193, lower right column, line 10 | Page 37, upper right column, the last line to lower right column, line 13 | Page 65, line 32 to page 66, line 17 |
| Surfactants | Page 201, lower left column, line 1 to page 210, upper right column, the last line | Page 18, upper right column, line 1 to page 24, lower right column, the last line; page 27, lower left column, line 10 from the bottom to lower right column, line 9 | — |
| Fluorine-Containing Compounds (Antistatic Agents, Coating Aids, Lubricants, Adhesion Inhibitors) | Page 210, lower right column, line 1 to page 222, lower left column, line 5 | Page 25, upper left column, line 1 to page 27, lower right column, line 9 | — |
| Binders (Hydrophilic Colloids) | Page 222, lower left column, line 6 to page 225, upper left 18 column, the last line | Page 38, upper right column, line 8 to line 18 | Page 66, line 23 to line 28 |
| Tackifiers | Page 225, upper right column, line 1 to page 227, upper right column, line 2 | — | — |
| Antistatic Agents | Page 227, upper right column, line 3 to page 230, upper left column, line 1 | — | — |
| Polymer Latices | Page 230, upper left column, line 2 to page 239, the last line | — | — |
| Matting Agents | Page 240, upper left column, line 1 to upper right column, the last line | — | — |
| Photographic Processing Methods (Processing Stages and Additives) | Page 3, upper right column, line 7 to page 10, upper right column, line 5 | Page 39, upper left column, line 4 to page 42, upper left column, the last line | Page 67, line 14 to page 69, line 28 |

Note:
The cited portions of JP-A-62-215272 include the contents of the amendment dated March, 16, 1987 which was given in the end of this publication. In addition, of the above-described color couplers, as yellow couplers, so-called short wave type yellow couplers are also preferably used which are described in JP-A-63-231451, JP-A-63-123047, JP-A-63-241547, JP-A-1-173499, JP-A-1-213648 and JP-A-1-250944.

Cyan couplers preferably used include 3-hydroxypyridine cyan couplers described in European Patent EP0,333,185A2 (a coupler of 2 equivalents made by giving a chlorine elminable group to the 4 equivalent coupler of coupler (42), couplers (6) and (9), which are concretely enumerated, are particularly preferred among others), cyclic active methylene cyan couplers described in JP-A-64-32260 (couplers 3, 8 and 34, concretely enumerated, are particularly preferred among others), as well as diphenylimidazole cyan couplers described in JP-A-2-33144.

As a method for processing the silver halide color photographic materials using the high silver chloride emulsions containing at least 90 mol % of silver chloride, the method described on page 27, upper left column to page 34, upper right column is preferably applied.

The following examples are provided for illustrative purposes only and are in no way intended to limit the scope of the present invention.

EXAMPLE 1

To a 3% aqueous solution of gelatin treated with lime, 6.4 g of sodium chloride was added. Then, 3.2 ml of N,N'-dimethylimidazolidine-2-thione (1% aqueous solution) was added to the resulting mixture. An aqueous solution containing 0.2 mol of silver nitrate, and an aqueous solution containing 0.08 mol of potassium bromide and 0.12 mol of sodium chloride were added to this solution. The resulting solution was mixed at 52° C. while vigorously stirring. Subsequently, an aqueous solution containing 0.6 mol of silver nitrate, and an aqueous solution containing 0.24 mol of potassium bromide and 0.36 mol of sodium chloride, were added thereto. The resulting solution was mixed at 52° C. while vigorously stirring. Successively, an aqueous solution containing 0.2 mol of silver nitrate; and an aqueous solution containing 0.08 mol of potassium bromide, 0.12 mol of sodium chloride and 0.04 mg of potassium hexachloroiridate (IV), were added thereto. The resulting solution was mixed at 52° C. while vigorously stirring. The resulting mixture was kept at 52° C. for 5 minutes, followed by desilverization and washing. Further, 90.0 g of gelatin treated with lime was added. A $4\times10^{-5}$ mol/mol amount of the silver halide of the spectral sensitizing dye (a) shown below, triethyl-thiourea and nucleic acid, were added thereto. This step was followed by optimal chemical and spectral sensitization. The resulting silver chlorobromide emulsion (containing 40 mol % of silver bromide) was named emulsion A-1.

An emulsion was prepared in the same manner as emulsion A-1 with the exception that the aqueous solution of the silver halide thirdly added, further contained $1.5\times10^{-5}$ mol/mol of the silver halide of sodium thiosulfate. This emulsion was named emulsion A-2.

An emulsion was prepared in the same manner as emulsion A-1 with the exception that the aqueous solution of the silver halide thirdly added, further contained $1.5\times10^{-6}$ mol/mol of the silver halide of dimethylselenourea. This emulsion was named emulsion A-3.

Then, 3.3 g of sodium chloride was added to a 3% aqueous solution of gelatin treated with lime. A 3.2 ml amount of N,N'-dimethylimidazolidine-2-thione (1% aqueous solution) was added to the resulting mixture. An aqueous solution containing 0.2 mol of silver nitrate and an aqueous solution containing 0.2 mol of sodium chloride were added to this solution and mixed at 52° C. while vigorously stirring. Subsequently, an aqueous solution containing 0.6 mol of silver nitrate and an aqueous solution containing 0.6 mol of sodium chloride were added thereto and mixed at 52° C. while vigorously stirring. Successively, an aqueous solution containing 0.2 mol of silver nitrate and an aqueous solution containing 0.2 mol of sodium chloride were added thereto and mixed at 52° C. while vigorously stirring. The resulting mixture was kept at 52° C. for 5 minutes, followed by desilverization and washing. Further, 90.0 g of gelatin treated with lime was added to the resulting mixture. Subsequently, $4\times10^{-5}$ mol/mol of the silver halide of the spectral sensitizing dye (a) shown below, 1.2 mol % based on the silver halide of a fine grain silver bromide emulsion (having a mean grain size of 0.05 μm and containing potassium hexachloroiridate (IV) in an amount of $1.5\times10^{-4}$ mol/mol of silver bromide), triethylthiourea and nucleic acid, were added thereto. This step was followed by optimal chemical sensitization. The resulting silver chloride emulsion was named emulsion B-1.

An emulsion was prepared in the same manner as emulsion B-1, with the exception that the aqueous solution of the silver halide thirdly added further contained $1.5\times10^{-5}$ mol/mol of the silver halide of sodium thiosulfate. This emulsion was named emulsion B-2.

An emulsion was prepared in the same manner as emulsion B-1 with the exception that the aqueous solution of the silver halide thirdly added further contained $1.5\times10^{-6}$ mol/mol of the silver halide of dimethylselenourea. This emulsion was named emulsion B-3.

An emulsion was prepared in the same manner as emulsion B-1 with the exception that the aqueous solutions of sodium chloride firstly, secondly and thirdly added, further contained 0.84 mg, 2.53 mg and 0.84 mg of potassium hexacyanoferrate (II) trihydrate, respectively. This emulsion was named emulsion C-1.

An emulsion was prepared in the same manner as emulsion C-1 with the exception that the aqueous solution of the silver halide thirdly added, further contained $1.5\times10^{-5}$ mol/mol of the silver halide of sodium thiosulfate. This emulsion was named emulsion C-2.

An emulsion was prepared in the same manner as emulsion C-1 with the exception that the aqueous solution of the silver halide thirdly added further contained $1.5\times10^{-6}$ mol/mol of the silver halide of dimethylselenourea. This emulsion was named emulsion C-3.

An emulsion was prepared in the same manner as emulsion B-1 with the exception that the aqueous solution of sodium chloride thirdly added, further contained 4.21 mg of potassium hexacyanoferrate (II) trihydrate. This emulsion was named emulsion D-1.

An emulsion was prepared in the same manner as emulsion D-1 with the exception that the aqueous solution of the silver halide thirdly added, further contained $1.5\times10^{-5}$ mol/mol of the silver halide of sodium thiosulfate. This emulsion was named emulsion D-2.

An emulsion was prepared in the same manner as emulsion D-1 with the exception that the aqueous solution of the silver halide thirdly added further contained $1.5\times10^{-6}$ mol/mol of the silver halide of dimethylselenourea. This emulsion was named emulsion D-3.

All of the silver halide grains contained in the 8 kinds of emulsions thus prepared are approximately equal to one another in size. The grains were in cubic form with a mean edge length of 0.5 μm, and the coefficient of variation of the grain size was 0.08.

The halogen compositions of these emulsions and the presence or absence of the iron compounds or the sulfur group compounds in the grains are summarized in Table 2.

Subsequently, 38.0 g of cyan coupler (b), 17.0 g of color image stabilizer (c), and 35.0 g of color image stabilizer (d), were dissolved in 40.0 ml of ethyl acetate and 23.0 g of solvent (e). The resulting solution was emulsified in 400 ml of a 10% aqueous solution of gelatin containing 20 ml of 10% sodium dodecylbenzenesulfonate.

Compound (f) was added to the silver halide emulsions obtained above in an amount of $1.0\times10^{-3}$ mol/mol of silver halide to prepare red-sensitive emulsions, and the above-described emulsified dispersion of the coupler was mixed therewith to prepare coating solutions so as to give the composition shown in Table 3. Paper supports, both surfaces of which were laminated with polyethylene, were coated with coating solutions according to the layer constitution shown in Table 3 to prepare 12 kinds of photographic materials. As a gelatin hardener of each layer, 1-oxy-3,5-dichloro-s-triazine sodium salt was used.

TABLE 2

| Emulsion | Halogen Composition | Iron Compound | Sulfur Group Compound |
|---|---|---|---|
| A-1 | $AgCl_{60}Br_{40}$ | Not contained | Not contained |
| A-2 | $AgCl_{60}Br_{40}$ | Not contained | Sodium thiosulfatex (contained in 20% surface layer) $1.5\times10^{-5}$ mol/molAg |
| A-3 | $AgCl_{60}Br_{40}$ | Not contained | Dimethylselenourea (contained in 20% surface layer) $1.5\times10^{-5}$ mol/molAg |
| B-1 | $AgCl_{98.8}Br_{1.2}$ | Not contained | Not contained |
| B-2 | $AgCl_{98.8}Br_{1.2}$ | Not contained | Sodium thiosulfatex (contained in 20% surface layer) $1.5\times10^{-5}$ mol/molAg |
| B-3 | $AgCl_{98.8}Br_{1.2}$ | Not contained | Dimethylselenourea (contained in 20% surface layer) $1.5\times10^{-5}$ mol/molAg |
| C-1 | $AgCl_{98.8}Br_{1.2}$ | Potassium hexacyanoferrate (II) (uniformly contained) $1\times10^{-5}$ mol/molAg | Not contained |
| C-2 | $AgCl_{98.8}Br_{1.2}$ | Potassium hexacyanoferrate (II) (uniformly contained) $1\times10^{-5}$ mol/molAg | Sodium thiosulfate (contained in 20% surface layer) $1.5\times10^{-5}$ mol/molAg |
| C-3 | $AgCl_{98.8}Br_{1.2}$ | Potassium hexacyanoferrate (II) (uniformly contained) $1\times10^{-5}$ mol/molAg | Dimethylselenourea (contained in 20% surface layer) $1.5\times10^{-5}$ mol/molAg |
| D-1 | $AgCl_{98.8}Br_{1.2}$ | Potassium hexacyanoferrate (II) (contained in 20% surface layer) $1\times10^{-5}$ mol/molAg | Not contained |
| D-2 | $AgCl_{98.8}Br_{1.2}$ | Potassium hexacyanoferrate (II) (contained in 20% surface layer) $1\times10^{-5}$ mol/molAg | Sodium thiosulfate (contained in 20% surface layer) $1.5\times10^{-5}$ mol/molAg |
| D-3 | $AgCl_{98.8}Br_{1.2}$ | Potassium hexacyanoferrate (II) (contained in 20% surface layer) $1\times10^{-5}$ mol/molAg | Dimethylselenourea (contained in 20% surface layer) $1.5\times10^{-5}$ mol/molAg |

Spectral Sensitizing Dye (a):

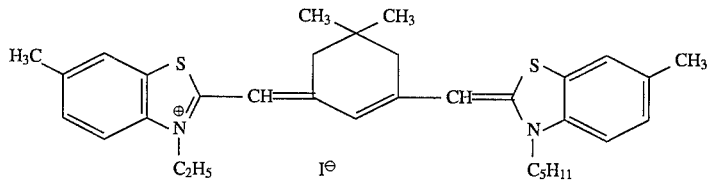

Cyan Coupler (b):

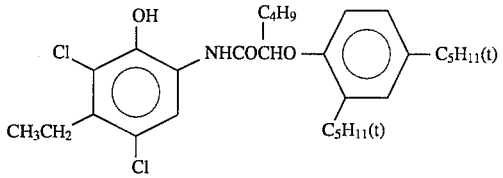

Color Image Stabilizer (c):

A 1:3:3 mixture (molar ratio) of

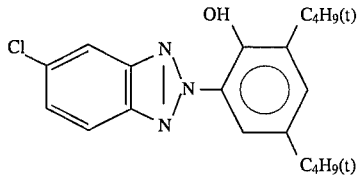

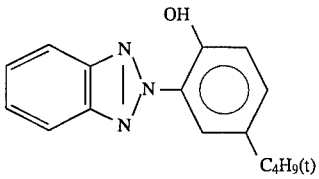

and

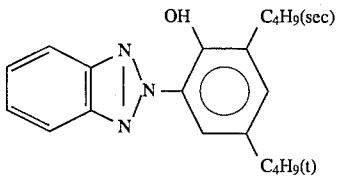

Color Image Stabilizer (d):

A polymer of

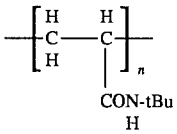

having a number average molecular weight of 60,000 Solvent (e):

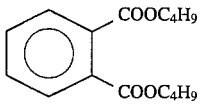

Compound (f):

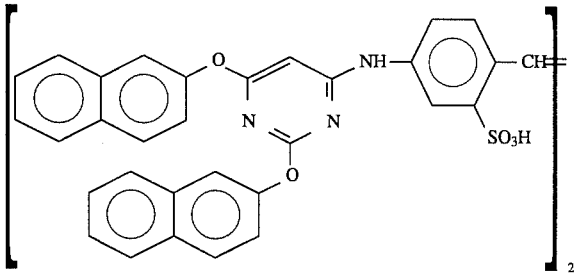

TABLE 3

| | |
|---|---|
| Second Layer (Protective Layer) | |
| Gelatin | 1.50 g/m$^2$ |
| First Layer (Red-Sensitive Layer) | |
| Silver (Bromo)chloride Emulsion (A-1 to A-3, B-1 to B-3, C-1 to C-3 and D-1 to D-3) | 0.24 g/m$^2$ (converted to silver) |
| Cyan Coupler (b) | 0.38 g/m$^2$ |
| Color Image Stabilizer (c) | 0.17 g/m$^2$ |
| Color Image Stabilizer (d) | 0.35 g/m$^2$ |
| Solvent (e) | 0.23 ml/m$^2$ |
| Gelatin | 1.00 g/m$^2$ |
| Support, Both Surfaces of Which are Laminated with Polyethylene | |

Polyethylene on the first layer side contains $TiO_2$ and ultramarine.

Using the 12 kinds of coated samples thus obtained (the same names as those of the emulsions used were given), the properties of the emulsions prepared were tested.

Each sample was exposed to 250 CMS at room temperature (24° C.) for 0.1 second through an optical wedge and a red filter (Filter SP-3, Fuji Kogaku), using a sensitometer (FWH type, Fuji Photo Film Co., Ltd.), and subjected to color development processing using the following processing stages and processing solutions. In this case, a comparison was made at both developing times of 20 seconds and 45 seconds to evaluate the rapid processability.

The reflection density of the processed samples thus prepared was measured to obtain characteristic curves. The fog density, relative sensitivity and contrast were determined from these characteristic curves. The relative sensitivity was indicated by a relative value, taking the reciprocal of the exposure to determine a density of 0.5 higher than the fog density as the sensitivity. Further, the sensitivity of sample A-1 was take at 100. The contrast was indicated by an increment in color forming density when the exposure was increased by 0.5 log E from that at which the sensitivity was determined.

Then, in order to know how the photographic properties changed when the temperature of the samples changed upon exposure, each sample was exposed to 250 CMS for 0.1 second at temperatures of 15° C. and 35° C., respectively, and subjected to development processing. From the resulting characteristic curves, the difference in the exposure resulting in a density 1.0 higher than the fog density was determined as a fluctuation in sensitivity with a change in temperature, and was represented by the log E unit.

These results are shown in Table 4.

| Processing Stage | Temperature (°C.) | Time (sec) |
|---|---|---|
| Color Development | 35 | 20, 45 |
| Bleach-Fixing | 35 | 45 |
| Rinsing (1) | 30–35 | 20 |
| Rinsing (2) | 30–35 | 20 |
| Rinsing (3) | 30–35 | 20 |
| Rinsing (4) | 30–35 | 30 |
| Drying | 70–80 | 60 |

(Three tank countercurrent system from rinsing (4) to rinsing (1) were employed.)

The composition of each processing solution was as follows.

| Color Developing Solution | |
|---|---|
| Water | 800 ml |
| Ethylenediamine-N,N,N',N'-tetramethylene-phosphonic Acid | 1.5 g |
| Potassium Bromide | 0.015 g |
| Triethanolamine | 8.0 g |
| Sodium Chloride | 1.4 g |
| Potassium Carbonate | 25.0 g |
| N-Ethyl-N-(β-methanesulfonamidoethyl)-3-methyl-4-aminoaniline Sulfate | 5.0 g |
| N,N-Bis(carboxymethyl)hydrazine | 4.0 g |
| N,N-Di(sulfoethyl)hydroxylamine Sodium Salt | 4.2 g |
| Fluorescent Brightener (WHITEX 4B, Sumitomo Chemical Co., Ltd.) | 1.0 g |
| Water to make | 1000 ml |
| pH (25° C.) | 10.10 |
| **Bleaching-Fixing Solution** | |
| Water | 400 ml |
| Ammonium Thiosulfate (700 g/l) | 100 ml |
| Sodium Sulfite | 17.0 g |
| Ethylenediaminetetraacetic Acid Fe (III) Ammonium Salt | 55.0 g |
| Disodium Ethylenediaminetetraacetate | 5.0 g |
| Ammonium Bromide | 40.0 g |
| Glacial Acetic Acid | 5.0 g |
| Water to make | 1000 ml |
| pH (25° C.) | 6.00 |
| Rinsing Solution | |
| Ion-Exchanged Water (the content of each of calcium and magnesium being not more than 3 ppm.) | |

According to sample B-1, using the emulsion containing 98.8 mol % of silver chloride, the rate of development is significantly increased, and high contrast can be obtained even by rapid processing. However, this sample is not practical because of its low sensitivity. Further, fluctuation in sensitivity is significantly increased with a change in temperature upon exposure.

For samples B-2 and B-3, using the emulsions to which the sulfur group compounds were added in forming the grains, a slight improvement in fluctuation in sensitivity is observed. However, these samples cannot be put to practical use because of a remarkable increase in fog.

In contrast, with respect to sample C-1, using the silver halide emulsion containing the iron compound, an increase in sensitivity and a reduction in fluctuation in sensitivity with a change in temperature upon exposure are observed. In addition, an increase in sensitivity and an improvement in temperature dependency are achieved by addition of the sulfur group compounds in forming the grains (samples C-2 and C-3). When the sulfur group compound is added, the increase in fog is also small. This tendency becomes more significant when the iron compound is localized near the surface of the grain (samples D-2 and D-3 to sample D-1).

According to the present invention, rapid processing becomes possible. Further, photographic materials high in sensitivity, high in contrast and decreased in fluctuation in sensitivity with a change in temperature upon exposure can be obtained.

EXAMPLE 2

Infrared-sensitive emulsions E-1 to H-3 were prepared in the same manner as the 12 kinds of emulsions A-1 to D-3 used in Example 1, with the exception that spectral sensitizing dye (g) (described below) was added in an amount of $5\times10^{-6}$ mol/mol of silver halide in place of spectral sensitizing dye (a). These emulsions were combined with the emulsified dispersion of the cyan coupler as in Example 1 to prepare 12 kinds of coated samples. The photographic properties of those sample were measured.

Each sample was exposed at room temperature (24° C.) for $10^{-3}$ second through an optical wedge and a red filter (Filter SP-3, Fuji Kogaku through which infrared light was allowed to pass), using a SENSITOMETER MARK VII (EG & G). Each sample was then subjected to color development processing similar to that of Example 1.

TABLE 4

| | Room Temperature (24° C.), 0.1 Sec | | | | | | Difference in Sensitivity between 15° C. and 35° C. Exposure for 0.1 Sec Exposure (Difference Giving a Reflection Density of +1.0 in Fog (log E)) | |
|---|---|---|---|---|---|---|---|---|
| | 20 Sec Development | | | 45 Sec Development | | | | |
| Sample | Fog | Sensitivity | Contrast | Fog | Sensitivity | Contrast | | Remark |
| A-1 | 0.08 | 25 | 0.41 | 0.09 | 100 | 0.78 | 0.07 | Comparison |
| A-2 | 0.10 | 28 | 0.42 | 0.12 | 115 | 0.81 | 0.06 | Comparison |
| A-3 | 0.12 | 32 | 0.42 | 0.14 | 122 | 0.80 | 0.06 | Comparison |
| B-1 | 0.08 | 86 | 1.38 | 0.09 | 131 | 1.41 | 0.21 | Comparison |
| B-2 | 0.17 | 87 | 1.36 | 0.24 | 133 | 1.40 | 0.17 | Comparison |
| B-3 | 0.21 | 90 | 1.35 | 0.37 | 136 | 1.38 | 0.15 | Comparison |
| C-1 | 0.08 | 123 | 1.45 | 0.09 | 183 | 1.47 | 0.13 | Comparison |
| C-2 | 0.09 | 131 | 1.43 | 0.11 | 194 | 1.46 | 0.08 | Invention |
| C-3 | 0.11 | 146 | 1.44 | 0.13 | 217 | 1.45 | 0.06 | Invention |
| D-1 | 0.08 | 304 | 1.50 | 0.09 | 422 | 1.53 | 0.09 | Comparison |
| D-2 | 0.08 | 353 | 1.49 | 0.10 | 489 | 1.52 | 0.06 | Invention |
| D-3 | 0.09 | 383 | 1.50 | 0.11 | 532 | 1.52 | 0.04 | Invention |

The remarkable effect of the present invention can be found from the results shown in Table 4. Namely, sample A-1 using the emulsion containing 40 mol % of silver bromide is decreased in a fluctuation in sensitivity when the temperature upon exposure is changed. However, the rate of development is reduced and the sample is markedly decreased in contrast when tested for rapid processing time. This demonstrates that Sample A-1 cannot be of practical use.

For samples A-2 and A-3, using the emulsions to which the sulfur group compounds were added in forming the silver halide grains, a slight increase in sensitivity is observed. However, these samples also have the disadvantage of being slow in the rate of development.

Subsequently, each sample was exposed for $10^{-3}$ second at temperatures of 15° C. and 35° C., respectively, and subjected to development processing as in Example 1.

From the measurement of the reflection density of the processed samples, the fog, contrast and relative sensitivity of the samples exposed at room temperature were determined. The fluctuation in sensitivity between the temperatures for the samples was also determined. The fluctuation data was obtained by changing the temperature upon exposure, as in Example 1.

These results are shown in Table 5.

Spectral Sensitizing Dye (g):

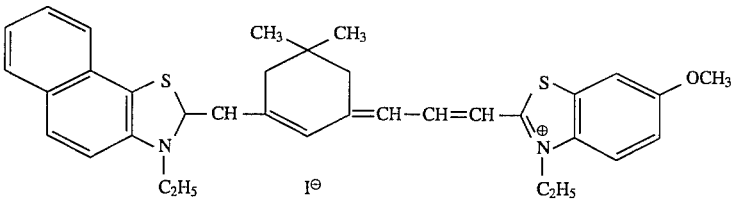

TABLE 5

| Sample | Room Temperature (24° C.), $10^{-3}$ Sec | | | | | | Difference in Sensitivity between 15° C. and 35° C. Exposure for $10^{-3}$ Sec Exposure (Difference Giving a Reflection Density of +1.0 in Fog (log E)) | Remark |
|---|---|---|---|---|---|---|---|---|
| | 20 Sec Development | | | 45 Sec Development | | | | |
| | Fog | Sensitivity | Contrast | Fog | Sensitivity | Contrast | | |
| E-1 | 0.08 | 21 | 0.30 | 0.09 | 100 | 0.66 | 0.10 | Comparison |
| E-2 | 0.10 | 25 | 0.31 | 0.11 | 124 | 0.70 | 0.09 | Comparison |
| E-3 | 0.11 | 35 | 0.32 | 0.14 | 134 | 0.71 | 0.09 | Comparison |
| F-1 | 0.08 | 65 | 1.32 | 0.10 | 105 | 1.35 | 0.29 | Comparison |
| F-2 | 0.16 | 67 | 1.31 | 0.23 | 109 | 1.34 | 0.27 | Comparison |
| F-3 | 0.22 | 69 | 1.30 | 0.38 | 111 | 1.33 | 0.26 | Comparison |
| G-1 | 0.08 | 113 | 1.41 | 0.09 | 176 | 1.43 | 0.17 | Comparison |
| G-2 | 0.09 | 127 | 1.40 | 0.12 | 198 | 1.42 | 0.09 | Invention |
| G-3 | 0.10 | 141 | 1.39 | 0.12 | 221 | 1.40 | 0.07 | Invention |
| H-1 | 0.08 | 266 | 1.48 | 0.09 | 417 | 1.51 | 0.13 | Comparison |
| H-2 | 0.09 | 321 | 1.47 | 0.11 | 502 | 1.50 | 0.08 | Invention |
| H-3 | 0.09 | 351 | 1.47 | 0.11 | 549 | 1.50 | 0.06 | Invention |

The results shown in Table 5 reveal that the effect of the present invention is more remarkable when the emulsions are exposed to high illumination for a short time. Samples E-1 to E-3, using the emulsions containing 40 mol % of silver bromide, is decreased in fluctuation in sensitivity with a change in temperature upon exposure. However, the rate of development was largely reduced. In contrast, samples F-1 to F-3, using the emulsions containing 98.8 mol % of silver chloride, can be rapidly developed, but are insufficient upon high illumination exposure. For these samples, the temperature dependency of high illuminance exposure sensitivity is also high. Although a slight improvement is observed by addition of the sulfur group compounds, it is insufficient. It becomes possible to obtain photographic materials high in sensitivity, high in contrast and prossessing reduced temperature dependency upon exposure, by use of the iron compounds and the sulfur group compounds in combination (G-2, G-3, H-2 and H-3) according to the present invention. Similarly, with the results of Example 1, the effect of the present invention becomes more significant when the emulsion contains the silver halide grain, the surface of which is intensively doped with the iron compound.

EXAMPLE 3

In the preparation of silver halide emulsion B-1 in Example 1, the temperature used during grain formation was changed to 72° C., and the addition time of the aqueous solution of silver nitrate and the aqueous solution of sodium chloride was changed to prepare an emulsion containing cubic silver halide grains having a mean grain size of 0.91 μm and a coefficient of variation of the grain size distribution of 6%. Instead of spectral sensitizing dye (a), sensitizing dyes A and B shown below, were each added to the emulsion in an amount of $2.0\times10^{-4}$ mol/mol of silver halide. Further, the amount of triethylthiourea (a sulfur sensitizer) added was adjusted to allow for optimal chemical sensitization. The resulting emulsion was named emulsion I-1.

An emulsion was prepared in the same manner as emulsion I-1, with the exception that the aqueous solution of sodium chloride thirdly added in the grain forming stage further contained $1.5\times10^{-6}$ mol/mol of the silver halide of triphenylphosphine selenide. This emulsion was named emulsion I-2.

Then, in the preparation of emulsion D-1 in Example 1, the temperature used when the grains were formed was changed to 72° C. Further, the addition time of the aqueous solution of silver nitrate and the aqueous solution of sodium chloride was changed to prepare an emulsion containing cubic silver halide grains having a mean grain size of 0.91 μm and a coefficient of variation of the grain size distribution of 6%. Instead of spectral sensitizing dye (a), sensitizing dyes A and B shown below were each added to the emulsion in an amount of $2.0\times10^{-4}$ mol/mol of silver halide. Further, the amount of triethylthiourea (a sulfur sensitizer) added was adjusted to allow for optimal chemical sensitization. The resulting emulsion was named emulsion I-3.

An emulsion was prepared in the same manner as emulsion I-3, with the exception that the aqueous solution of sodium chloride thirdly added in the grain forming stage further contained $1.5\times10^{-6}$ mol/mol of the silver halide of triphenylphosphine selenide. This emulsion was named emulsion I-4.

Then, in the preparation of emulsion B-1 in Example 1, the temperature used when the grains were formed was changed to 64° C. Further, the addition time of the aqueous solution of silver nitrate and the aqueous solution of sodium chloride was changed to prepare an emulsion containing cubic silver halide grains having a mean grain size of 0.71 μm and a coefficient of variation of the grain size distribution of 7%. Instead of spectral sensitizing dye (a), sensitizing dyes A and B shown below were each added to the emulsion in an amount of $2.5\times10^{-4}$ mol/mol of silver halide. Further, the amount of triethylthiourea added was adjusted to allow for optimal chemical sensitization. The resulting emulsion was named emulsion J-1.

An emulsion was prepared in the same manner as emulsion J-1, with the exception that the aqueous solution of sodium chloride thirdly added in the grain forming stage further contained $1.5\times10^{-6}$ mol/mol of the silver halide of triphenylphosphine selenide. This emulsion was named emulsion J-2.

In the preparation of emulsion D-1 in Example 1, the temperature used when the grains were formed was changed to 64° C. Further, the addition time of the aqueous solution of silver nitrate and the aqueous solution of sodium chloride was changed to prepare an emulsion containing cubic silver halide grains having a mean grain size of 0.71 μm and a coefficient of variation of the grain size distribution of 7%. Instead of spectral sensitizing dye (a), sensitizing dyes A and B shown below were each added to the emulsion in an amount of $2.5\times10^{-4}$ mol/mol of silver halide. Further, the amount of triethylthiourea added was adjusted to allow for optimal chemical sensitization. The resulting emulsion was named emulsion J-3.

An emulsion was prepared in the same manner as emulsion J-3, with the exception that the aqueous solution of sodium chloride thirdly added in the grain forming stage further contained $1.5\times10^{-6}$ mol/mol of the silver halide of triphenylphosphine selenide. This emulsion was named emulsion J-4.

In the preparation of emulsion B-1 in Example 1, the temperature used upon grain formation was changed to 56° C. Further, the addition time of the aqueous solution of silver nitrate and the aqueous solution of sodium chloride was changed to prepare an emulsion containing cubic silver halide grains having a mean grain size of 0.54 μm and a coefficient of variation of the grain size of 7%. Instead of spectral sensitizing dye (a), sensitizing dyes C and D (shown below) were added to the emulsion in amounts of $4.0\times10^{-4}$ mol and $7.0\times10^{-5}$ mol/mol of silver halide, respectively, at the point of grain formation termination. Further, the amount of triethylthiourea added was adjusted to allow for optimal chemical sensitization. The resulting emulsion was named emulsion K-1.

An emulsion was prepared in the same manner as emulsion K-1, with the exception that the aqueous solution of sodium chloride thirdly added in the grain forming stage further contained $1.5\times10^{-6}$ mol/mol of the silver halide of triphenylphosphine selenide. This emulsion was named emulsion K-2.

In the preparation of emulsion D-1 in Example 1, the temperature used during grain formation was changed to 56° C. Further, the addition time of the aqueous solution of silver nitrate and the aqueous solution of sodium chloride was changed to prepare an emulsion containing cubic silver halide grains having a mean grain size of 0.54 μm and a coefficient of variation of the grain size of 7%. Instead of spectral sensitizing dye (a), sensitizing dyes C and D (shown below) were added to the emulsion in an amount of $4.0\times10^{-4}$ mol and $7.0\times10^{-5}$ mol/mol of silver halide, respectively, upon complete grain formation. Further, the amount of triethylthiourea added was adjusted to allow for optimal chemical sensitization. The resulting emulsion was named emulsion K-3.

An emulsion was prepared in the same manner as emulsion K-3, with the exception that the aqueous solution of sodium chloride thirdly added in the grain forming stage further contained $1.5\times10^{-6}$ mol/mol of the silver halide of triphenylphosphine selenide. This emulsion was named emulsion K-4.

Then, in the preparation of emulsion B-1 in Example 1, the temperature used during grain formation was changed to 54° C. Further, the addition time of the aqueous solution of silver nitrate and the aqueous solution of sodium chloride was changed to prepare an emulsion containing cubic silver halide grains having a mean grain size of 0.43 μm and a coefficient of variation of the grain size of 8%. Instead of spectral sensitizing dye (a), sensitizing dyes C and D (shown below) were added to the emulsion in an amount of $5.6\times10^{-4}$ mol and $1.0\times10^{-4}$ mol/mol of silver halide, respectively, upon complete grain formation. Further, the amount of triethylthiourea added was adjusted to allow for optimal chemical sensitization. The resulting emulsion was named emulsion L-1.

An emulsion was prepared in the same manner as emulsion L-1, with the exception that the aqueous solution of sodium chloride thirdly added in the grain forming stage further contained $1.5\times10^{-6}$ mol/mol of the silver halide of triphenylphosphine selenide. This emulsion was named emulsion L-2.

Then, in the preparation of emulsion D-1 in Example 1, the temperature used when the grains were formed was changed to 54° C. Further, the addition time of the aqueous solution of silver nitrate and the aqueous solution of sodium chloride was changed to prepare an emulsion containing cubic silver halide grains having a mean grain size of 0.43 μm and a coefficient of variation of the grain size of 8%. Instead of spectral sensitizing dye (a), sensitizing dyes C and D (shown below) were added to the emulsion in an amount of $5.6\times10^{-4}$ mol and $1.0\times10^{-4}$ mol/mol of silver halide, respectively, upon complete grain formation. In addition, the amount of triethylthiourea added was adjusted to allow for optimal chemical sensitization. The resulting emulsion was named emulsion L-3.

An emulsion was prepared in the same manner as emulsion L-3, with the exception that the aqueous solution of sodium chloride thirdly added in the grain forming stage further contained $1.5\times10^{-6}$ mol/mol of the silver halide of triphenylphosphine selenide. This emulsion was named emulsion L-4.

In the preparation of emulsion B-1 in Example 1, the addition time of the aqueous solution of silver nitrate and the aqueous solution of sodium chloride was changed to prepare an emulsion containing cubic silver halide grains having a mean grain size of 0.64 μm and a coefficient of variation of the grain size distribution of 7%. The amount of spectral sensitizing dye (a) added was further changed to $9.0\times10^{-5}$ mol/mol of silver halide. Further, the amount of triethylthiourea added was adjusted to allow for optimal chemical sensitization. The resulting emulsion was named emulsion M-1.

An emulsion was prepared in the same manner as emulsion M-1, with the exception that the aqueous solution of sodium chloride thirdly added in the grain forming stage further contained $1.5\times10^{-6}$ mol/mol of the silver halide of triphenylphosphine selenide. This emulsion was named emulsion M-2.

In the preparation of emulsion D-1 in Example 1, the addition time of the aqueous solution of silver nitrate and the aqueous solution of sodium chloride was changed to prepare an emulsion containing cubic silver halide grains having a mean grain size of 0.64 μm and a coefficient of variation of the grain size distribution of 7%. The amount of spectral sensitizing dye (a) added was further changed to $9.0\times10^{-5}$ mol/mol of silver halide. Further, the amount of triethylthiourea added was adjusted to allow for optimal chemical sensitization. The resulting emulsion was named emulsion M-3.

An emulsion was prepared in the same manner as emulsion M-3, with the exception that the aqueous solution of sodium chloride thirdly added in the grain forming stage further contained $1.5\times10^{-6}$ mol/mol of the silver halide of triphenylphosphine selenide. This emulsion was named emulsion M-4.

In the preparation of emulsion B-1 in Example 1, the addition time of the aqueous solution of silver nitrate and the aqueous solution of sodium chloride was changed to prepare an emulsion containing cubic silver halide grains having a mean grain size of 0.52 μm and a coefficient of variation of the grain size distribution of 8%. The amount of spectral sensitizing dye (a) added was further changed to $1.1\times10^{-4}$ mol/mol of silver halide. Further, the amount of triethylthiourea added was adjusted to allow for optimal chemical sensitization. The resulting emulsion was named emulsion N-1.

An emulsion was prepared in the same manner as emulsion N-1, with the exception that the aqueous solution of sodium chloride thirdly added in the grain forming stage further contained $1.5\times10^{-6}$ mol/mol of the silver halide of triphenylphosphine selenide. This emulsion was named emulsion N-2.

Then, in the preparation of emulsion D-1 in Example 1, the addition time of the aqueous solution of silver nitrate and the aqueous solution of sodium chloride was changed to prepare an emulsion containing cubic silver halide grains having a mean grain size of 0.52 μm and a coefficient of variation of the grain size distribution of 8%. The amount of spectral sensitizing dye (a) added was further changed to $1.1\times10^{-4}$ mol/mol of silver halide. In addition, the amount of triethylthiourea added was adjusted to conduct optimal chemical sensitization. The resulting emulsion was named emulsion N-3.

An emulsion was prepared in the same manner as emulsion N-3, with the exception that the aqueous solution of sodium chloride thirdly added in the grain forming stage further contained $1.5\times10^{-6}$ mol/mol of the silver halide of triphenylphosphine selenide. This emulsion was named emulsion N-4.

The 24 kinds of silver halide emulsions thus prepared were combined to produce 4 kinds of multilayer color photographic materials, samples 3-1 to 3-4. Each coating solution was prepared similarly by the process disclosed in Example 1. The combinations of silver halide emulsions used, the layer constitutions and the amount of compounds used are summarized in Table 6.

For prevention of fog and stabilization, 1-(5-methylureidophenyl)-5-mercaptotetrazole was added to each silver halide emulsion layer in an amount of $5.0\times10^{-4}$ mol/mol of silver halide. As antiseptics, Cpd-10 and Cpd-11 were added to each layer to a total amount of 25.0 mg/m$^2$ and 50.0 mg/m$^2$, respectively.

As a gelatin hardener of each layer, 1-oxy-3,5-dichloro-s-triazine sodium salt was used.

TABLE 6

| | Sample 3-1 | Sample 3-2 |
|---|---|---|
| Support | | |
| Paper laminated with polyethylene (polyethylene on the side of the first layer containing $TiO_2$ and a slight amount of ultramarine) | | |
| First Layer (Blue-Sensitive Layer) | | |
| Silver Halide Emulsion | I-1/J-1 | I-2/J-2 |
| Coated Amounts Converted to Silver | 0.09/0.21 | 0.09/0.21 |
| Gelatin | 1.22 | 1.22 |
| Yellow Coupler (ExY) | 0.82 | 0.82 |
| Color Image Stabilizer (Cpd-1) | 0.19 | 0.19 |
| Color image Stabilizer (Cpd-7) | 0.06 | 0.06 |
| Solvent (Solv-3) | 0.18 | 0.18 |
| Solvent (Solv-7) | 0.18 | 0.18 |
| Second Layer (Color Mixing Preventing Layer) | | |
| Gelatin | 0.64 | 0.64 |
| Color Mixing Inhibitor (Cpd-5) | 0.10 | 0.10 |
| Solvent (Solv-1) | 0.16 | 0.16 |
| Solvent (Solv-4) | 0.08 | 0.08 |
| Third Layer (Green-Sensitive Layer) | | |
| Silver Halide Emulsion | K-1/L-1 | K-2/L-2 |
| Coated Amounts Converted to Silver | 0.04/0.08 | 0.04/0.08 |
| Gelatin | 1.28 | 1.28 |
| Magenta Coupler (ExM) | 0.23 | 0.23 |
| Color Image Stabilizer (Cpd-2) | 0.03 | 0.03 |
| Color Image Stabilizer (Cpd-3) | 0.16 | 0.16 |
| Color Image Stabilizer (Cpd-4) | 0.02 | 0.02 |
| Color Image Stabilizer (Cpd-9) | 0.02 | 0.02 |
| Solvent (Solv-2) | 0.40 | 0.40 |
| Fourth Layer (Ultraviolet Light Absorbing Layer) | | |
| Gelatin | 1.41 | 1.41 |
| Ultraviolet Light Absorber (UV-1) | 0.47 | 0.47 |
| Color Mixing Inhibitor (Cpd-5) | 0.05 | 0.05 |
| Solvent (Solv-5) | 0.24 | 0.24 |
| Fifth Layer (Red-Sensitive Layer) | | |
| Silver Halide Emulsion | M-1/N-1 | M-2/N-2 |
| Coated Amounts Converted to Silver | 0.10/0.13 | 0.10/0.13 |
| Gelatin | 1.04 | 1.04 |
| Cyan Coupler (ExC) | 0.32 | 0.32 |
| Color Image Stabilizer (Cpd-2) | 0.03 | 0.03 |
| Color Image Stabilizer (Cpd-4) | 0.02 | 0.02 |
| Color Image Stabilizer (Cpd-6) | 0.18 | 0.18 |
| Color Image Stabilizer (Cpd-7) | 0.40 | 0.40 |
| Color Image Stabilizer (Cpd-8) | 0.05 | 0.05 |
| Solvent (Solv-6) | 0.14 | 0.14 |
| Sixth Layer (Ultraviolet Light Absorbing Layer) | | |
| Gelatin | 0.48 | 0.48 |
| Ultraviolet Light Absorber (UV-1) | 0.16 | 0.16 |
| Color Mixing Inhibitor (Cpd-5) | 0.02 | 0.02 |
| Solvent (Solv-5) | 0.08 | 0.08 |
| Seventh Layer (Protective Layer) | | |
| Gelatin | 1.10 | 1.10 |
| Acrylic Modified Copolymer of Polyvinyl Alcohol (degree of modification: 17%) | 0.17 | 0.17 |
| Liquid Paraffin | 0.03 | 0.03 |

Numerals in respective columns indicate coated amounts per m$^2$ (g/m$^2$).

TABLE 6-continued

| | Sample 3-3 | Sample 3-4 |
|---|---|---|
| Support | | |
| Paper laminated with polyethylene (polyethylene on the side of the first layer containing $TiO_2$ and a slight amount of ultramarine) | | |
| First Layer (Blue-Sensitive Layer) | | |
| Silver Halide Emulsion | I-3/J-3 | I-4/J-4 |
| Coated Amounts Converted to Silver | 0.09/0.21 | 0.09/0.21 |
| Gelatin | 1.22 | 1.22 |
| Yellow Coupler (ExY) | 0.82 | 0.82 |
| Color Image Stabilizer (Cpd-1) | 0.19 | 0.19 |
| Color Image Stabilizer (Cpd-7) | 0.06 | 0.06 |
| Solvent (Solv-3) | 0.18 | 0.18 |
| Solvent (Solv-7) | 0.18 | 0.18 |
| Second Layer (Color Mixing Preventing Layer) | | |
| Gelatin | 0.64 | 0.64 |
| Color Mixing Inhibitor (Cpd-5) | 0.08 | 0.08 |
| Solvent (Solv-1) | 0.16 | 0.16 |
| Solvent (Solv-4) | 0.08 | 0.08 |
| Third Layer (Green-Sensitive Layer) | | |
| Silver Halide Emulsion | K-3/L-3 | K-4/L-4 |
| Coated Amounts Converted to Silver | 0.04/0.08 | 0.04/0.08 |
| Gelatin | 1.28 | 1.28 |
| Magenta Coupler (ExM) | 0.23 | 0.23 |
| Color Image Stabilizer (Cpd-2) | 0.03 | 0.03 |
| Color Image Stabilizer (Cpd-3) | 0.16 | 0.16 |
| Color Image Stabilizer (Cpd-4) | 0.02 | 0.02 |
| Color Image Stabilizer (Cpd-9) | 0.02 | 0.02 |
| Solvent (Solv-2) | 0.40 | 0.40 |
| Fourth Layer (Ultraviolet Light Absorbing Layer) | | |
| Gelatin | 1.41 | 1.41 |
| Ultraviolet Light Absorber (UV-1) | 0.47 | 0.47 |
| Color Mixing Inhibitor (Cpd-5) | 0.05 | 0.05 |
| Solvent (Solv-5) | 0.24 | 0.24 |
| Fifth Layer (Red-Sensitive Layer) | | |
| Silver Halide Emulsion | M-3/N-3 | M-4/N-4 |
| Coated Amounts Converted to Silver | 0.10/0.13 | 0.04/0.13 |
| Gelatin | 1.04 | 1.04 |
| Cyan Coupler (ExC) | 0.32 | 0.32 |
| Color Image Stabilizer (Cpd-2) | 0.03 | 0.03 |
| Color Image Stabilizer (Cpd-4) | 0.02 | 0.02 |
| Color Image Stabilizer (Cpd-6) | 0.18 | 0.18 |
| Color Image Stabilizer (Cpd-7) | 0.40 | 0.40 |
| Color Image Stabilizer (Cpd-8) | 0.05 | 0.05 |
| Solvent (Solv-6) | 0.14 | 0.14 |
| Sixth Layer (Ultraviolet Light Absorbing Layer) | | |
| Gelatin | 0.48 | 0.48 |
| Ultraviolet Light Absorber (UV-1) | 0.16 | 0.16 |

TABLE 6-continued

| | | |
|---|---|---|
| Color Mixing Inhibitor (Cpd-5) | 0.02 | 0.02 |
| Solvent (Solv-5) | 0.08 | 0.08 |
| Seventh Layer (Protective Layer) | | |
| Gelatin | 1.10 | 1.10 |
| Acrylic Modified Copolymer of Polyvinyl Alcohol (degree of modification: 17%) | 0.17 | 0.17 |
| Liquid Paraffin | 0.03 | 0.03 |

Numerals in respective columns indicate coated amounts per $m^2$ ($g/m^2$).

Blue-Sensitive Emulsion Layer:

Sensitizing Dye A

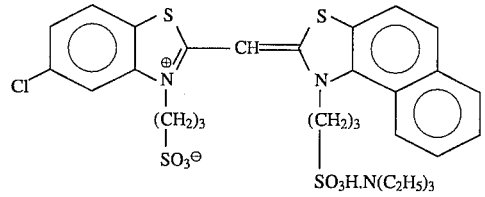

and

Sensitizing Dye B

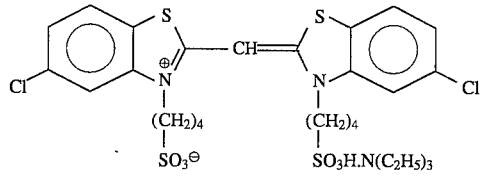

($2.0 \times 10^{-4}$ mol/mol of silver halide, respectively, for a large-sized emulsion; and $2.5 \times 10^{-4}$ mol/mol of silver halide, respectively, for a small-sized emulsion)

Green-Sensitive Emulsion Layer:

Sensitizing Dye C

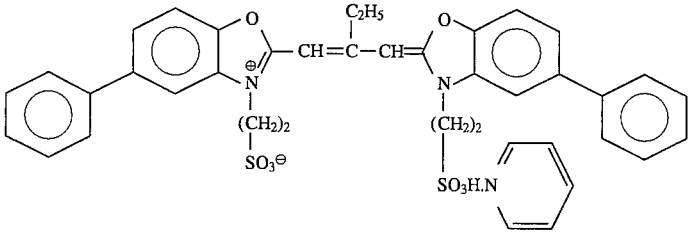

($4.0 \times 10^{-4}$ mol/mol of silver halide, for a large-sized emulsion, and $5.6 \times 10^{-4}$ mol/mol of silver halide, for a small-sized emulsion), and Sensitizing Dye D

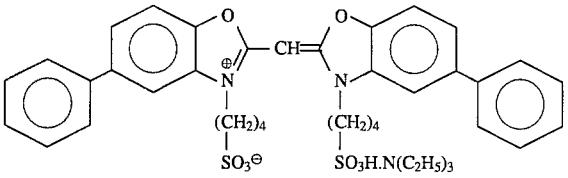

($7.0 \times 10^{-5}$ mol/mol of silver halide, for a large-sized emulsion; and $1.0 \times 10^{-5}$ mol/mol of silver halide, for a small-sized emulsion)

Red-Sensitive Emulsion Layer:

Sensitizing Dye E

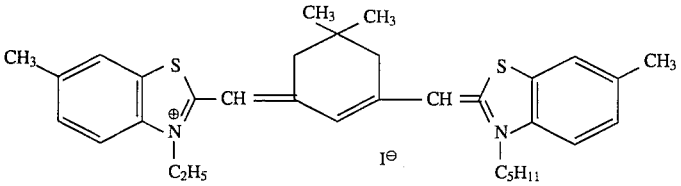

The following compound was further added in an amount of $2.6 \times 10^{-3}$ mol/mol of silver halide:

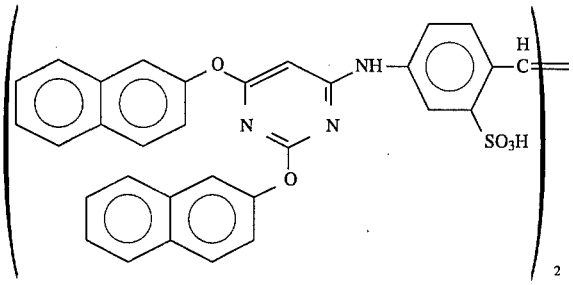

(ExY) Yellow Coupler:

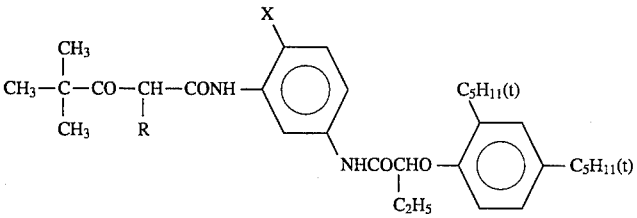

A 1:1 mixture (molar ratio) of R represents

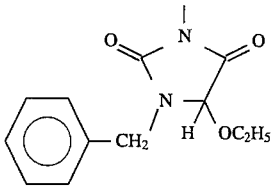

X represents Cl and R represents

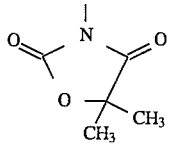

X represents $OCH_3$ (ExM) Magenta Coupler:

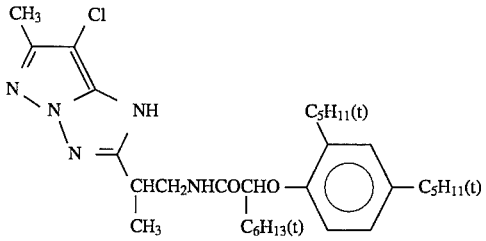

(ExC) Cyan Coupler:

A 1:1 mixture (molar ratio)

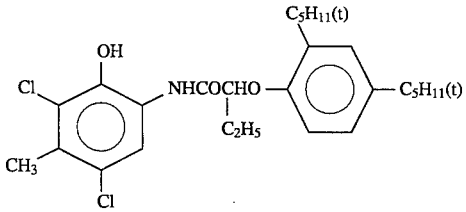

and

-continued
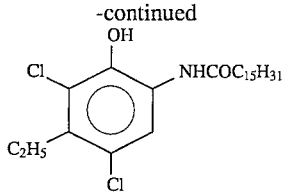
Cpd-1 ) Color Image Stabilizer:
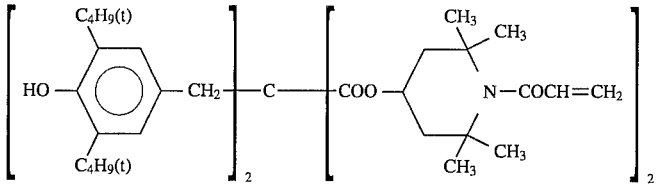
(Cpd-2) Color Image Stabilizer:
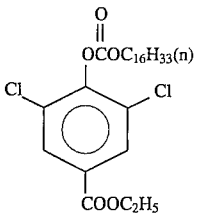
(Cpd-3) Color Image Stabilizer:
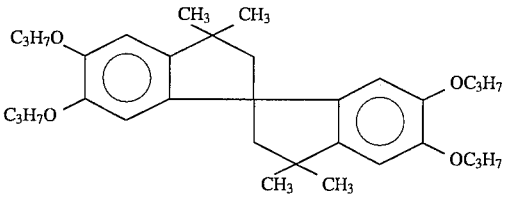
(Cpd-4) Color Image Stabilizer:
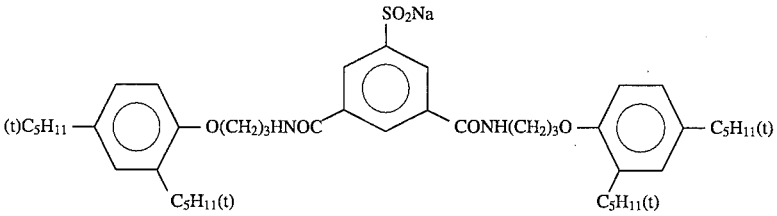
(Cpd-5) Color Mixing Inhibitor:
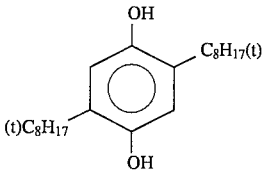
(Cpd-6 ) Color Image Stabilizer:
A 2:4:4 mixture (weight ratio) of
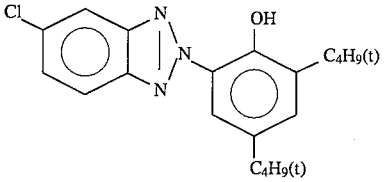
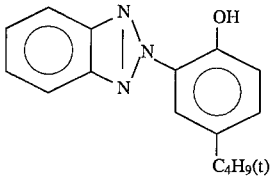
and
-continued
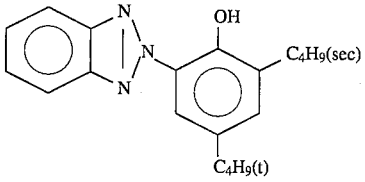

(Cpd-7) Color Image Stabilizer:

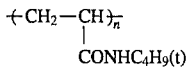

(average molecular weight: 60,000)

(Cpd-8 ) Color Image Stabilizer:

A 1:1 mixture (weight ratio) of

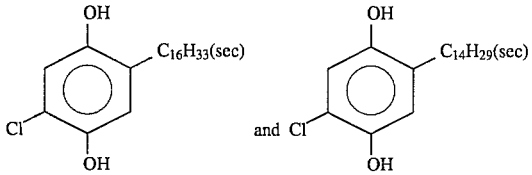

(Cpd-9) Color Image Stabilizer:

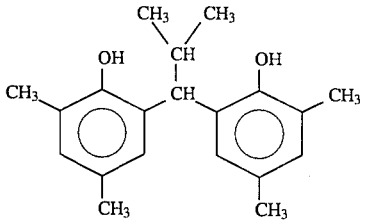

(Cpd-10) Antiseptic:

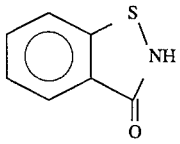

(Cpd-11) Antiseptic:

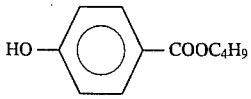

(UV-1) Ultraviolet Light Absorber:

A 4:2:4 mixture (weight ratio) of

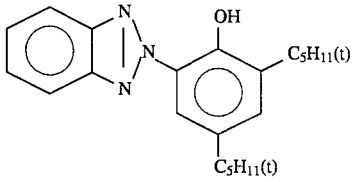

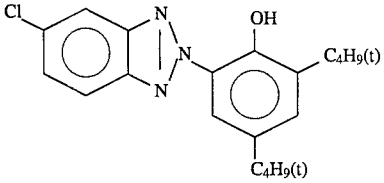

and

-continued

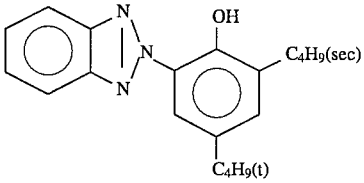

(Solv-1 ) Solvent:

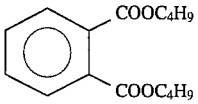

(Solv-2) Solvent:

A 1:1 mixture (volume ratio) of

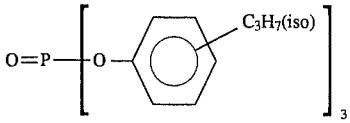

and

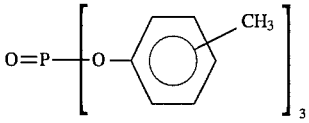

(Solve-3) Solvent:

$O{=}P{+}O{-}C_9H_{19}(iso)]_3$ (Solve-4 ) Solvent:

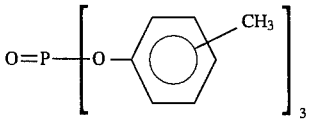

(Solv-5) Solvent:

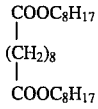

(Solv-6) Solvent:

An 80:20 mixture (volume ratio) of

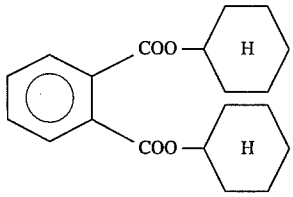

and

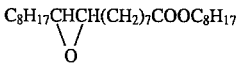

(Solv-7) Solvent:

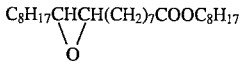

The following dyes were added to each emulsion layer to prevent irradiation (numerals in parentheses indicate amounts coated:

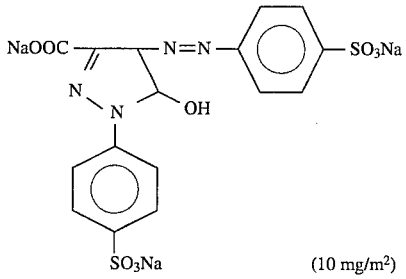

(10 mg/m²)

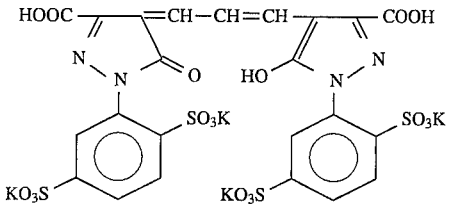

(10 mg/m²)

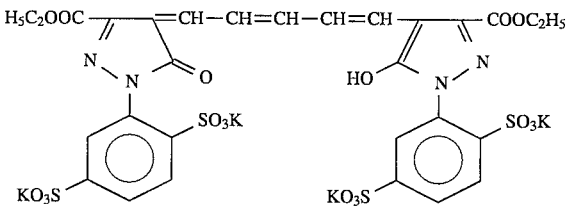

(40 mg/m²)

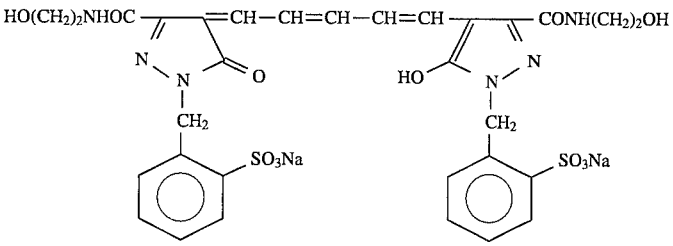

(20 mg/m²)

The photographic properties of these color photographic materials were tested as follows.

At first, each sample was exposed to 250 CMS at room temperature (24° C.) for 0.1 second through an optical wedge and each of blue, green and red filters, using the same sensitometer as used in Example 1. Each of the exposed samples was subjected to color development processing with a paper processor, using the following processing stages and processing solutions.

| Processing Stage | Temperature (°C.) | Time (sec) | Replenisher* (ml) | Tank Capacity (liter) |
|---|---|---|---|---|
| Color Development | 35 | 45 | 161 | 17 |
| Bleach-Fixing | 30–35 | 45 | 215 | 17 |

-continued

| Processing Stage | Temperature (°C.) | Time (sec) | Replenisher* (ml) | Tank Capacity (liter) |
|---|---|---|---|---|
| Rinsing (1) | 30–35 | 20 | — | 10 |
| Rinsing (2) | 30–35 | 20 | — | 10 |
| Rinsing (3) | 30–35 | 20 | 350 | 10 |
| Drying | 70–80 | 60 | | |

*Replenishment rate: ml/m² of photographic material (Three tank counter-current systems from rinsing (3) to rinsing (1) was employed.)

The composition of each processing solution was as follows:

| | Tank Solution | Replenisher |
|---|---|---|
| Color Developing Solution | | |
| Water | 800 ml | 800 ml |
| Ethylenediamine-N,N,N',N'-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| N,N-Bis(carboxymethyl)hydrazine | 4.0 g | 5.0 g |
| N,N-Di(sulfoethyl)hydroxylamine Sodium Salt | 4.0 g | 5.0 g |
| Fluorescent Brightener (WHITEX 4B, Sumitomo Chemical Co., Ltd.) | 1.0 g | 2.0 g |
| Water to make | 1000 ml | 1000 ml |
| pH (25° C.) | 10.05 | 10.45 |
| Bleach-Fixing Solution (tank solution and replenisher being the same) | | |
| Water | | 400 ml |
| Ammonium Thiosulfate (70%) | | 100 ml |
| Sodium Sulfite | | 17 g |
| Ethylenediaminetetraacetic Acid Fe (III) Ammonium | | 55 g |
| Disodium Ethylenediaminetetraacetate | | 5 g |
| Ammonium Bromide | | 40 g |
| Water to make | | 1000 ml |
| pH (25° C.) | | 6.0 |
| Rinsing Solution (tank solution and replenisher being the same) | | |
| Ion-Exchanged Water (the content of calcium and magnesium, each being not more than 3 ppm.) | | |

After processing, the reflection density of the samples was measured to obtain characteristic curves. The sensitivity of blue-, green- and red-sensitive layers were determined therefrom. The sensitivity was determined based on the basis used in Example 1. The sensitivity was further indicated by a relative value, setting the sensitivity of sample 3 at 100.

The following experiment was performed next to examine how much the sensitivity fluctuated with a change in temperature upon exposure.

A processed color negative film (Fuji Color HG100), in which a gray patch corresponding to a density of 0.8 taken in a standard scene at the standard exposure level, was prepared. Using the above-described film, each sample was printed by an automatic printer (FAP3500, Fuji Photo Film Co., ltd.) according to the following procedure. Color development processing was conducted immediately after printing and under the same conditions as those of the sensitometry.

1. When the morning room temperature was 13° C., the printer was started. The air conditioner was used to increase the room temperature to 22° C. Using sample 3-1, printing conditions were adjusted, and 25 frames were continuously printed. At this time, the temperature of the exposed part of the sample was measured and determined to be 14.5° C.

2. Printing was continued for an hour and a half using commercial color photographic paper to maintain the continuous operating state of the printer.

3. The photographic material was changed to sample 3-1 again, and 25 frames were continuously printed under the conditions used in 1 above. The temperature of the exposed part of the sample was increased to 28.7° C.

4. Printing was continuously performed again for 2 hours using commercial photographic paper.

5. The photographic material was changed to sample 3-1, and 25 frames were continuously printed under the conditions in 1 above. The temperature of the exposed part of the sample was increased to 33.2° C.

6. With respect to each of the above-described three printings, the color forming density of the gray patches on pictures was measured. A mean value was then calculated for the 25 frames.

The same experiments were carried out using samples 3-2, 3-3 and 3-4. The results are summarized in Table 7.

It is apparent from the results that the color photographic materials prepared by use of the emulsions containing the iron compounds and the sulfur group compounds in the silver halide grains according to the present invention are high in sensitivity. Further, the results show that these color photographic materials are significantly repressed in fluctuation property with a change in temperature at the exposing part which takes place in operating the printer continuously.

TABLE 7

| Sample | Sensitivity | Print Density on Continuous Operation (Temperature of Exposing Part) First | Second | Third | Remark |
|---|---|---|---|---|---|
| 3-1 | B 100 | Y 0.74 | 0.77 | 0.82 | Comparison |
| | G 100 | M 0.79 (14.5° C.) | 0.84 (28.7°) | 0.89 (33.2°) | |
| | R 100 | C 0.80 | 0.89 | 0.94 | |
| 3-2 | B 105 | Y 0.75 | 0.78 | 0.83 | Comparison |
| | G 106 | M 0.81 (14.2°) | 0.86 (28.8°) | 0.90 (34.9° C.) | |
| | R 111 | C 0.81 | 0.88 | 0.92 | |
| 3-3 | B 314 | Y 0.76 | 0.78 | 0.81 | Comparison |
| | G 317 | M 0.80 (14.6° C.) | 0.83 (28.1° C.) | 0.86 (33.1° C.) | |
| | R 323 | C 0.81 | 0.84 | 0.89 | |
| 3-4 | B 366 | Y 0.75 | 0.77 | 0.77 | Invention |
| | G 380 | M 0.81 (14.4° C.) | 0.82 (28.5° C.) | 0.84 (33.9° C.) | |
| | R 408 | C 0.82 | 0.83 | 0.86 | |

EXAMPLE 4

In the preparation of silver halide emulsion B-1 in Example 1, the temperature used when the grains were formed was changed to 56° C. Further, the addition time of the aqueous solution of silver nitrate and the aqueous solution of sodium chloride was changed to prepare an emulsion containing cubic silver halide grains having a mean grain size of 0.53 μm and a coefficient of variation of the grain size distribution of 8%. At this time, 16.0 μg of rhodium trichloride trihydrate was added to the aqueous solution of sodium chloride secondly added in the grain forming stage. Instead of spectral sensitizing dye (a), sensitizing dyes F and G (shown below) were each added to the emulsion in an amount of $1.0\times10^{-4}$ mol/mol of silver halide, and the amount of triethylthiourea, a sulfur sensitizer, added was adjusted to allow for optimal chemical sensitization. The resulting emulsion was named emulsion O1.

An emulsion was prepared in the same manner as emulsion O-1, with the exception that spectral sensitizing dye H (shown below) was added in an amount of $4.5\times10^{-5}$ mol/mol of silver halide in place of spectral sensitizing dyes F and G. Further, the amount of triethylthiourea added was adjusted to allow for optimal chemical sensitization. The resulting emulsion was named emulsion P-1.

An emulsion was prepared in the same manner as emulsion O-1, with the exception that spectral sensitizing dye I (shown below) was added in an amount of $5.0\times10^{-6}$ mol/ mol of silver halide in place of spectral sensitizing dyes F and G. Further, the amount of triethylthiourea added was adjusted to allow for optimal chemical sensitization. The resulting emulsion was named emulsion Q-1.

An emulsion was prepared in the same manner as emulsion O-1, with the exception that the aqueous solution of sodium chloride thirdly added in the grain forming stage further contained $1.5\times10^{-6}$ mol/mol of the silver halide of triphenylphosphine selenide. This emulsion was named emulsion O-2.

An emulsion was prepared in the same manner as emulsion P-1, with the exception that the aqueous solution of sodium chloride thirdly added in the grain forming stage further contained $1.5\times10^{-6}$ mol/mol of the silver halide of triphenylphosphine selenide. This emulsion was named emulsion P-2.

An emulsion was prepared in the same manner as emulsion Q-1, with the exception that the aqueous solution of sodium chloride thirdly added in the grain forming stage further contained $1.5\times10^{-6}$ mol/mol of the silver halide of triphenylphosphine selenide. This emulsion was named emulsion Q-2.

In the preparation of silver halide emulsion D-1 in Example 1, the temperature used when the grains were formed was changed to 56° C. Further, the addition time of the aqueous solution of silver nitrate and the aqueous solution of sodium chloride was changed to prepare an emulsion containing cubic silver halide grains having a mean grain size of 0.53 μm and a coefficient of variation of the grain size distribution of 8%. At this time, 16.0 μg of rhodium trichloride trihydrate was added to the aqueous solution of sodium chloride secondly added in the grain forming stage. Instead of spectral sensitizing dye (a), sensitizing dyes F and G (shown below) were each added to the emulsion in an amount of $1.0\times10^{-4}$ mol/mol of silver halide. Further, the amount of triethylthiourea added was adjusted to allow for optimal chemical sensitization. The resulting emulsion was named emulsion O-3.

An emulsion was prepared in the same manner as emulsion O-3, with the exception that spectral sensitizing dye H (shown below) was added in an amount of $4.5\times10^{-5}$ mol/mol of silver halide in place of spectral sensitizing dyes F and G. Further, the amount of triethylthiourea added was adjusted to allow for optimal chemical sensitization. The resulting emulsion was named emulsion P-3.

An emulsion was prepared in the same manner as emulsion O-3, with the exception that spectral sensitizing dye I (shown below) was added in an amount of $5.0\times10^{-6}$ mol/mol of silver halide in place of spectral sensitizing dyes F and G. Further, the amount of triethylthiourea added was adjusted to allow for optimal chemical sensitization. The resulting emulsion was named emulsion Q-3.

An emulsion was prepared in the same manner as emulsion O-3, with the exception that the aqueous solution of sodium chloride thirdly added in the grain forming stage further contained $1.5\times10^{-6}$ mol/mol of the silver halide of triphenylphosphine selenide. This emulsion was named emulsion O-4.

An emulsion was prepared in the same manner as emulsion P-3, with the exception that the aqueous solution of sodium chloride thirdly added in the grain forming stage further contained $1.5\times10^{-6}$ mol/mol of the silver halide of triphenylphosphine selenide. This emulsion was named emulsion P-4.

An emulsion was prepared in the same manner as emulsion Q-3, with the exception that the aqueous solution of sodium chloride thirdly added in the grain forming stage further contained $1.5\times10^{-6}$ mol/mol of the silver halide of triphenylphosphine selenide. This emulsion was named emulsion Q-4.

The 12 kinds of silver halide emulsions thus prepared were combined to produce 4 kinds of multilayer color photographic materials, i.e., samples 4-1 to 4-4. These photographic materials were sensitized to infrared rays. Each coating solution was prepared as shown in Example 1. The combinations of silver halide emulsions, the layer constitutions and the amount of compounds used are summarized in Table 8.

Sensitizing Dye F

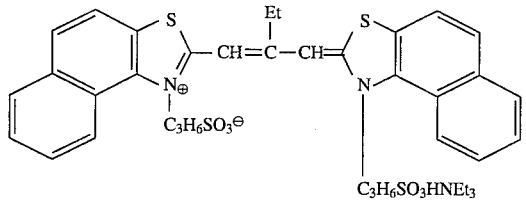

Sensitizing Dye G

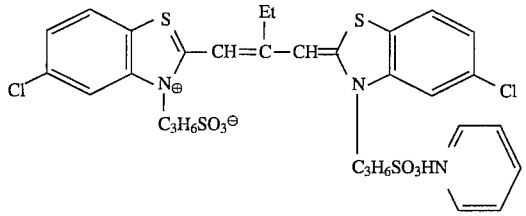

($1.0\times10^{-4}$mol/mol of silver halide)

Sensitizing Dye H

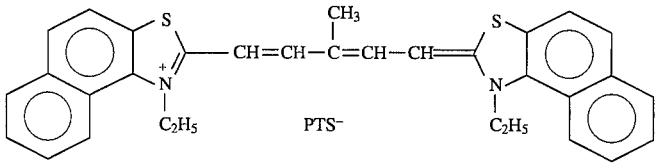

($4.5\times10^{-5}$ mol/mol of silver halide)

Sensitizing Dye I

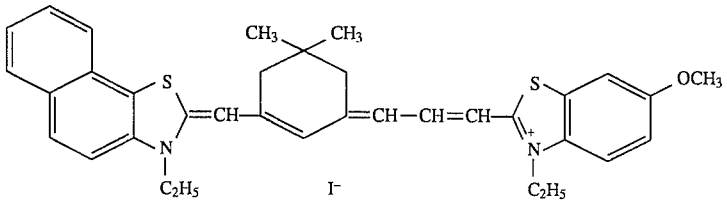

($0.5\times10^{-5}$ mol/mol of silver halide)

When spectral sensitizing dyes H and I were used, the supersensitizer (f) used in Example 1 was added in an amount of $1.8\times10^{-3}$ mol/mol of silver halide.

TABLE 8

| | Sample 4-1 | Sample 4-2 |
|---|---|---|
| Support | | |
| Paper laminated with polyethylene (polyethylene on the side of the first layer which contained $TiO_2$ and a slight amount of ultramarine) | | |
| First Layer (Red-Sensitive Yellow Color Forming Layer) | | |
| Silver Halide Emulsion | O-1 | O-2 |
| Coated Amounts Converted to Silver | 0.30 | 0.30 |
| Gelatin | 1.22 | 1.22 |
| Yellow Coupler (ExY) | 0.82 | 0.82 |
| Color Image Stabilizer (Cpd-1) | 0.19 | 0.19 |
| Color Image Stabilizer (Cpd-7) | 0.06 | 0.06 |
| Solvent (Solv-3) | 0.18 | 0.18 |
| Solvent (Solv-7) | 0.18 | 0.18 |
| Second Layer (Color Mixing Preventing Layer | | |
| Gelatin | 0.64 | 0.64 |
| Color Mixing Inhibitor (Cpd-5) | 0.10 | 0.10 |
| Solvent (Solv-1) | 0.16 | 0.16 |
| Solvent (Solv-4) | 0.08 | 0.08 |
| Third Layer (Infrared-Sensitive Magenta Color Forming Layer) | | |
| Silver Halide Emulsion | P-1 | P-2 |
| Coated Amounts Converted to Silver | 0.12 | 0.12 |
| Gelatin | 1.28 | 1.28 |
| Magenta Coupler (ExM) | 0.23 | 0.23 |
| Color Image Stabilizer (Cpd-2) | 0.03 | 0.03 |
| Color Image Stabilizer (Cpd-3) | 0.16 | 0.16 |
| Color Image Stabilizer (Cpd-4) | 0.02 | 0.02 |
| Color Image Stabilizer (Cpd-9) | 0.02 | 0.02 |
| Solvent (Solv-2) | 0.40 | 0.40 |
| Fourth Layer (Ultraviolet Light Absorbing Layer) | | |
| Gelatin | 1.41 | 1.41 |
| Ultraviolet Light Absorber (UV-1) | 0.47 | 0.47 |
| Color Mixing Inhibitor (Cpd-5) | 0.05 | 0.05 |
| Solvent (Solv-5) | 0.24 | 0.24 |
| Fifth Layer (Infrared-Sensitive Cyan Color Forming Layer) | | |
| Silver Halide Emulsion | Q-1 | Q-2 |
| Coated Amounts Converted to Silver | 0.23 | 0.23 |
| Gelatin | 1.04 | 1.04 |
| Cyan Coupler (ExC) | 0.32 | 0.32 |
| Color Image Stabilizer (Cpd-2) | 0.03 | 0.03 |
| Color Image Stabilizer (Cpd-4) | 0.02 | 0.02 |
| Color Image Stabilizer (Cpd-6) | 0.18 | 0.18 |
| Color Image Stabilizer (Cpd-7) | 0.40 | 0.40 |
| Color Image Stabilizer (Cpd-8) | 0.05 | 0.05 |
| Solvent (Solv-6) | 0.14 | 0.14 |
| Sixth Layer (Ultraviolet Light Absorbing Layer) | | |
| Gelatin | 0.48 | 0.48 |
| Ultraviolet Light Absorber (UV-1) | 0.16 | 0.16 |

TABLE 8-continued

| | | |
|---|---|---|
| Color Mixing Inhibitor (Cpd-5) | 0.02 | 0.02 |
| Solvent (Solv-5) | 0.08 | 0.08 |
| Seventh Layer (Protective Layer) | | |
| Gelatin | 1.10 | 1.10 |
| Acrylic Modified Copolymer of Polyvinyl Alcohol (degree of modification: 17%) | 0.17 | 0.17 |
| Liquid Paraffin | 0.03 | 0.03 |

Numerals in respective columns indicate coated amounts per $m^2$ ($g/m^2$).

| | Sample 4-3 | Sample 4-4 |
|---|---|---|
| Support | | |
| Paper laminated with polyethylene (polyethylene on the side of the first layer which contained $TiO_2$ and a slight amount of ultramarine) | | |
| First Layer (Red-Sensitive Yellow Color Forming Layer) | | |
| Silver Halide Emulsion | O-3 | O-4 |
| Coated Amounts Converted to Silver | 0.30 | 0.30 |
| Gelatin | 1.22 | 1.22 |
| Yellow Coupler (ExY) | 0.82 | 0.82 |
| Color Image Stabilizer (Cpd-1) | 0.19 | 0.19 |
| Color Image Stabilizer (Cpd-7) | 0.06 | 0.06 |
| Solvent (Solv-3) | 0.18 | 0.18 |
| Solvent (Solv-7) | 0.18 | 0.18 |
| Second Layer (Color Mixing Preventing Layer) | | |
| Gelatin | 0.64 | 0.64 |
| Color Mixing Inhibitor (Cpd-5) | 0.08 | 0.08 |
| Solvent (Solv-1) | 0.16 | 0.16 |
| Solvent (Solv-4) | 0.08 | 0.08 |
| Third Layer (Infrared-Sensitive Magenta Color Forming Layer) | | |
| Silver Halide Emulsion | P-3 | P-4 |
| Coated Amounts Converted to Silver | 0.12 | 0.12 |
| Gelatin | 1.28 | 1.28 |
| Magenta Coupler (ExM) | 0.23 | 0.23 |
| Color Image Stabilizer (Cpd-2) | 0.03 | 0.03 |
| Color Image Stabilizer (Cpd-3) | 0.16 | 0.16 |
| Color Image Stabilizer (Cpd-4) | 0.02 | 0.02 |
| Color Image Stabilizer (Cpd-9) | 0.02 | 0.02 |
| Solvent (Solv-2) | 0.40 | 0.40 |
| Fourth Layer (Ultraviolet Light Absorbing Layer) | | |
| Gelatin | 1.41 | 1.41 |
| Ultraviolet Light Absorber (UV-1) | 0.47 | 0.47 |
| Color Mixing Inhibitor (Cpd-5) | 0.05 | 0.05 |
| Solvent (Solv-5) | 0.24 | 0.24 |
| Fifth Layer (Infrared-Sensitive Cyan Color Forming Layer) | | |
| Silver Halide Emulsion | Q-3 | Q-4 |
| Coated Amounts Converted to Silver | 0.23 | 0.23 |
| Gelatin | 1.04 | 1.04 |
| Cyan Coupler (ExC) | 0.32 | 0.32 |
| Color Image Stabilizer (Cpd-2) | 0.03 | 0.03 |
| Color Image Stabilizer (Cpd-4) | 0.02 | 0.02 |
| Color Image Stabilizer (Cpd-6) | 0.18 | 0.18 |
| Color Image Stabilizer (Cpd-7) | 0.40 | 0.40 |

TABLE 8-continued

| | | |
|---|---|---|
| Color Image Stabilizer (Cpd-8) | 0.05 | 0.05 |
| Solvent (Solv-6) | 0.14 | 0.14 |
| Sixth Layer Ultraviolet Light Absorbing Layer | | |
| Gelatin | 0.48 | 0.48 |
| Ultraviolet Light Absorber (UV-1) | 0.16 | 0.16 |
| Color Mixing Inhibitor (Cpd-5) | 0.02 | 0.02 |
| Solvent (Solv-5) | 0.08 | 0.08 |
| Seventh Layer (Protective Layer) | | |
| Gelatin | 1.10 | 1.10 |
| Acrylic Modified Copolymer of Polyvinyl Alcohol (degree of modification: 17%) | 0.17 | 0.17 |
| Liquid Paraffin | 0.03 | 0.03 |

Numerals in respective columns indicate coated amounts per $m^2$ ($g/m^2$).

Further, 1-(5-methylureidophenyl)-5-mercaptotetrazole was added to each of the yellow, magenta and cyan color forming emulsion layers in an amount of $8.0\times10^{-4}$ mol/mol of silver halide.

The following dyes were added to each emulsion layer to prevent irradiation (numerals in parentheses indicate amounts coated:

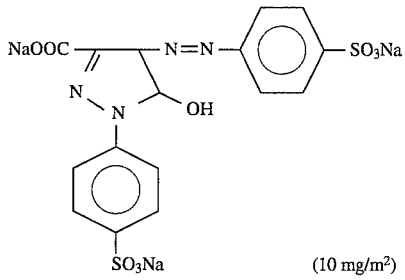

(10 mg/m²)

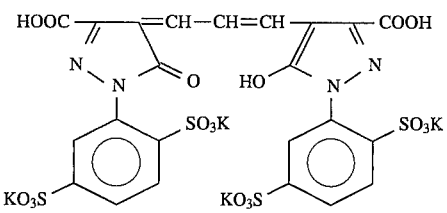

(10 mg/m²)

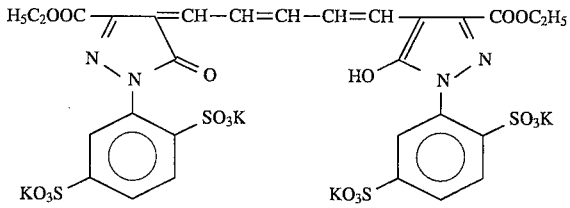

(40 mg/m²)

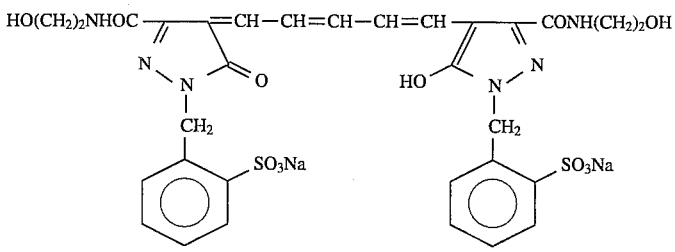

(20 mg/m²)

-continued

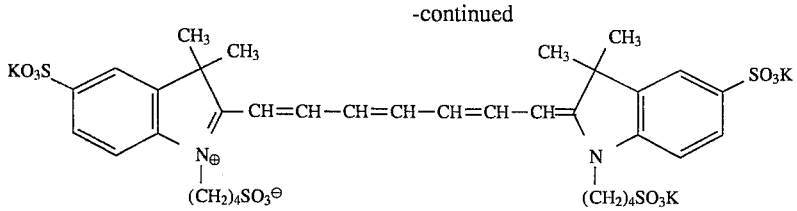

(10 mg/m²)

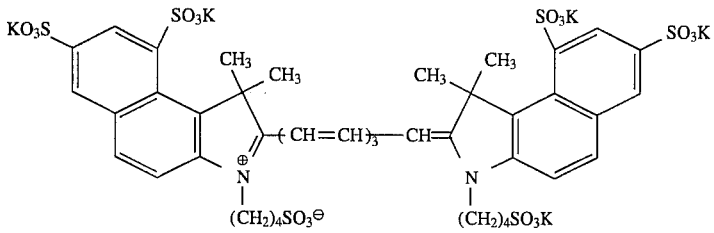

(5 mg/m²)

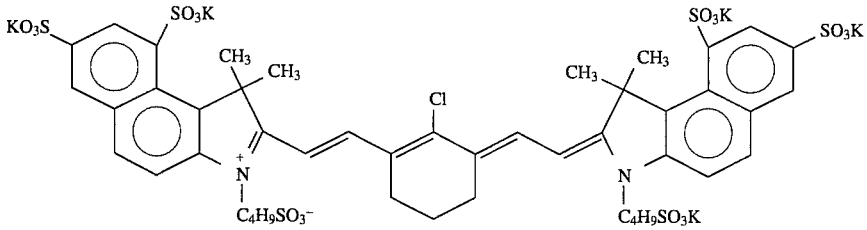

(5 mg/m²)

The symbols of the additives shown in Table 8 have the same meanings as disclosed in Example 3.

The properties of the 4 kinds of infrared-sensitive multilayer color photographic materials thus prepared were tested as follows.

A device was assembled using laser beams from 3 kinds of semiconductor lasers, e.g., AlGaInP (oscillation wavelength: about 670 nm), GaAlAs (oscillation wavelength: about 750 nm) and GaAl As (oscillation wavelength: about 830 nm), which were allowed to scan using reflection from rotary polyhedral mirror surfaces to the photographic material moving perpendicularly to this scanning direction and exposed. The exposure to the laser beams was adjusted by electrically controlling the light-emitting time and the amount of light emitted.

Exposure similar to that of ordinary sensitometry was given at a room temperature of 24° C., by controlling each laser beam so that an optical wedge-like change in exposure appeared on the photographic material as image information. The properties of the photographic emulsion layers corresponding to the respective wavelengths were tested.

In samples 4-1 to 4-4, the silver halide emulsions were combined so that the yellow color forming layer was exposed to a laser beam emitting at 670 nm. Further, the magenta color forming layer was exposed to a laser beam emitting at 750 nm. In addition, the cyan color forming layer was exposed to a laser beam emitting at 830 nm.

For the purpose of examining the fluctuation property of the photographic material with a change in temperature upon exposure, the temperature of the room in which the exposing device was installed was changed to 15° C. and 35° C. A change in sensitivity in this case was determined.

In all the above experiments, the exposed samples were subjected to color development processing using the following processing stages and processing solutions.

The results thereof are summarized in Table 9.

| Processing Stage | Temperature (° C.) | Time (sec) | Replenisher* (ml) | Tank Capacity (liter) |
|---|---|---|---|---|
| Color Development | 35 | 20 | 60 | 2 |
| Bleaching-Fixing | 30–35 | 20 | 60 | 2 |
| Rinsing (1) | 30–35 | 10 | — | 1 |
| Rinsing (2) | 30–35 | 10 | — | 1 |
| Rinsing (3) | 30–35 | 10 | 120 | 1 |
| Drying | 70–35 | 20 | | |

*Replenishment rate: ml/m² of photographic material. (Three tank countercurrent systems for rinsing (3) to (1) were employed.)

The composition of each processing solution was as follows.

| | Tank Solution | Replenisher |
|---|---|---|
| Color Developing Solution | | |
| Water | 800 ml | 800 ml |
| Ethylenediamine-N,N,N',N'-tetramethylenephosphonic Acid | 1.5 g | 2.0 g |
| Potassium Bromide | 0.015 g | — |
| Triethanolamine | 8.0 g | 12.0 g |
| Sodium Chloride | 4.9 g | — |
| Potassium Carbonate | 25 g | 37 g |
| 4-Amino-3-methyl-N-ethyl-(3-hydroxypropyl)aniline Di-p-toluenesulfonate | 12.8 g | 19.8 g |
| N,N-Bis(carboxymethyl)hydrazine | 5.5 g | 7.0 g |
| Fluorescent Brightener (WHITEX 4B, Sumitomo Chemical Co., Ltd.) | 1.0 g | 2.0 g |
| Water to make | 1000 ml | 1000 ml |
| pH (25° C.) | 10.05 | 10.45 |

-continued

| | Tank Solution | Replenisher |
|---|---|---|
| Bleach-Fixing Solution (tank solution and replenisher being the same) | | |
| Water | | 400 ml |
| Ammonium Thiosulfate (700 g/l) | | 100 ml |
| Sodium Sulfite | | 17 g |
| Ethylenediaminetetraacetic Acid Fe (III) Ammonium | | 55 g |
| Disodium Ethylenediaminetetraacetate | | 5 g |
| Ammonium Bromide | | 40 g |
| Water to make | | 1000 ml |
| pH (25° C.) | | 6.0 |
| Rinsing Solution (tank solution and replenisher being the same) | | |
| Ion-Exchanged Water (the content of each of calcium and magnesium being not more than 3 ppm.) | | |

TABLE 9

| Sample | Sensitivity 24° C. Exposure | Difference in Sensitivity between 15° C. and 35° C. Exposure (Difference in Exposure Giving a Density of 1.0 (log E)) | Remark |
|---|---|---|---|
| 4-1 | Y 100 | 0.09 | Comparison |
| | M 100 | 0.21 | |
| | C 100 | 0.29 | |
| 4-2 | Y 116 | 0.08 | Comparison |
| | M 117 | 0.20 | |
| | C 122 | 0.27 | |
| 4-3 | Y 409 | 0.05 | Comparison |
| | M 411 | 0.16 | |
| | C 421 | 0.19 | |
| 4-4 | Y 549 | 0.03 | Invention |
| | M 571 | 0.06 | |
| | C 613 | 0.07 | |

The sensitivity was determined by taking the reciprocal of an exposure providing a density of 1.0 and setting the relative value for the sensitivity of sample 4-1 as 100. In determining the fluctuation in sensitivity brought about by a change in temperature upon exposure, the difference in an exposure providing a density of 1.0 was represented by log E.

As is apparent from the results shown in Table 9, an increase in sensitivity and a reduction in fluctuation property with a change in temperature upon exposure due to the emulsions of the present invention, become more significant when the photographic materials in which the spectral sensitivity was given to the infrared regions were exposed to laser beams.

The results of the above Examples demonstrate that the high sensitive, hard silver halide emulsions of the present invention are excellent in rapid processing suitability and prevent fog formation. Further, the present invention provides silver halide photographic materials using the same. Furthermore, excellent silver halide emulsions decreased in fluctuation property with a change in temperature and photographic materials using the same, can be obtained by application of the present invention.

In addition, according to the present invention, an excellent effect can be obtained for silver halide emulsions used at a high intensity of illumination upon brief exposure. Excellent results are also obtained also obtained with photographic materials using these emulsions. The same is for the infrared-sensitized silver halide emulsions of the present invention used in laser exposure, and for the photographic materials using the same.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support and at least one light-sensitive emulsion layer provided thereon, wherein said emulsion layer comprises a surface latent image silver halide emulsion containing silver halide grains formed of silver chlorobromide, silver chloroiodide or silver, chloroiodobromide each containing at least 90 mol % of silver chloride, or silver chloride, wherein $10^{-7}$ to $10^{-3}$ mol/mol of silver halide of an iron compound and $10^{-7}$ to $10^{-4}$ mol/mol of silver halide of a sulfur group compound selected from a tellurium-containing compound, and a selenium-containing compound represented by formula (I) or (II) are added to said silver halide grains during grain formation at any time up until physical ripening of said grains is completed, wherein 80% or more of the iron compound and 80% or more of said sulfur group compound are localized in a surface layer of the silver halide grains, the volume of the surface layer being 40% or less of the entire grain volume, and then said silver halide emulsion is subjected to chemical sensitization;

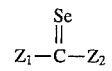

(I)

wherein $Z_1$ and $Z_2$, which may be the same or different, represent an alkyl group, an alkenyl group, an aryl group, a heterocyclic group, $—NR_1(R_2)$, $—OR_3$, or $—SR_4$, in which $R_1$ and $R_2$, which may be the same or different, represent a hydrogen atom, an alkyl group, an aryl group, a heterocylic group, or an acyl group and $R_3$ and $R_4$, which may be the same or different, represent an alkyl group, an aryl group or a heterocyclic group;

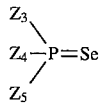

(II)

wherein $Z_3$, $Z_4$ and $Z_5$, which may be the same or different, represent an aliphatic group, an aromatic group, a heterocyclic group, $—OR_7$, $—NR_8(R_9)$, $—SR_{10}$, $—SeR_{11}$, —X or a hydrogen atom, in which $R_7$, $R_{10}$ and $R_{11}$ represent an aliphatic group, an aromatic group, a heterocyclic group, a hydrogen atom or a cation, $R_8$ and $R_9$ represent an aliphatic group, an aromatic group, a heterocyclic group or a hydrogen atom; and X represents a halogen atom.

2. The silver halide photographic material as claimed in claim 1, wherein said iron compound contained in the grains is a divalent or trivalent iron complex compound coordinated by 5 or 6 cyano ligands.

3. The silver halide photographic material as claimed in claim 1, wherein said sulfur group compound is said selenium-containing compound represented by formula (I) or (II).

4. The silver halide photographic material as claimed in claim 1, wherein said sulfur group compound is a tellurium-containing compound selected from the group consisting of tellurocarbamides, allyl isotellurocyanates, potassium tellurocyanates and allyl tellurourea compounds.

5. The silver halide photographic material as claimed in claim 1, wherein said selenium-containing compound is selected from the group consisting of N,N-dialkylselenourea, an N,N,N'-trialkyl-N'-acyl-selenourea, a tetraalkylselenourea, an N,N-dialkyl-arylselenoamide, N-alkyl-N-aryl-arylselenoamide, trialkylphosphine selenides, triarylphosphine selenides, trialkyl selenophosphates and triaryl selenophosphates.

6. The silver halide photographic material as claimed in claim 1, wherein said volume of the surface layer is 20% or less.

7. The silver halide photographic material as claimed in claim 1, wherein the amount of the sulfur group compound is within the range of $5\times10^{-6}$ to $5\times10^{-5}$ mol/mol of silver halide.

8. The silver halide photographic material as claimed in claim 1, wherein the amount of the iron compound is within the range of $10^{-6}$ to $10^{-4}$ mol/mol of silver halide.

9. The silver halide photographic material as claimed in claim 1, wherein said silver halide emulsion contains silver halide grains formed of silver chlorobromide containing at least 98 mol % of silver chloride, or silver chloride.

10. The silver halide photographic material as claimed in claim 1, wherein said silver halide emulsion contains silver halide grains formed of silver chlorobromide having a silver bromide-localized phase.

* * * * *